US005900577A

United States Patent [19]

Robinson et al.

[11] Patent Number: 5,900,577

[45] Date of Patent: May 4, 1999

[54] MODULAR, MULTI-CALIBER WEAPON SYSTEM

[75] Inventors: Alexander J. Robinson, Salt Lake City; Darin G. Nebeker, Layton, both of Utah

[73] Assignee: ZDF Import Export Inc, Salt Lake City, Utah

[21] Appl. No.: 08/791,065

[22] Filed: Jan. 29, 1997

[51] Int. Cl.[6] ..... F41A 5/00

[52] U.S. Cl. ..... 89/191.01; 89/156

[58] Field of Search ..... 89/191.01, 191.02, 89/192, 193, 33.04, 33.01, 156; 42/18, 22, 50

[56] References Cited

U.S. PATENT DOCUMENTS

| | | | |
|---|---|---|---|
| D. 250,942 | 1/1979 | Appelblatt | D12/12 |
| D. 252,453 | 7/1979 | Appelblatt et al. | D12/13 |
| D. 269,418 | 6/1983 | Appelblatt et al. | D12/12 |
| D. 315,535 | 3/1991 | Lockhart | D12/12 |
| 1,786,207 | 12/1930 | Hudson | 89/191.01 |
| 2,116,141 | 5/1938 | Browning | 89/193 |
| 2,681,718 | 6/1954 | Stoner | 192/139 |
| 2,696,967 | 12/1954 | Wilson et al. | 251/174 |
| 2,765,558 | 10/1956 | Roper et al. | 42/18 |
| 2,848,904 | 8/1958 | Wilson et al. | 74/625 |
| 2,895,248 | 7/1959 | Sawin | 42/50 |
| 3,097,982 | 7/1963 | Stoner | 156/211 |
| 3,120,785 | 2/1964 | Lorimer et al. | 89/47 |
| 3,198,076 | 8/1965 | Stoner | 39/128 |
| 3,386,336 | 6/1968 | Roy | 89/191.01 |
| 3,405,599 | 10/1968 | Barlow et al. | 89/41 |
| 3,916,795 | 11/1975 | Lemstra | 102/92.7 |
| 3,999,461 | 12/1976 | Johnson et al. | 89/191.01 |
| 4,069,740 | 1/1978 | Hottinger et al. | 89/33.01 |
| 4,097,695 | 6/1978 | Grace et al. | 179/15 |
| 4,146,780 | 3/1979 | Spreg | 235/412 |
| 4,174,653 | 11/1979 | Appelblatt | 89/36 |
| 4,237,788 | 12/1980 | Hagen | 102/245 |
| 4,242,964 | 1/1981 | Warren et al. | 102/275 |
| 4,283,989 | 8/1981 | Toulios et al. | 89/6.5 |
| 4,395,938 | 8/1983 | Curtis | 89/193 |
| 4,457,206 | 7/1984 | Toulios et al. | 89/14 R |
| 4,475,438 | 10/1984 | Sullivan | 89/191.01 |
| 4,579,034 | 4/1986 | Holloway | 89/33.01 |
| 4,640,182 | 2/1987 | De Haven et al. | 89/47 |
| 4,671,164 | 6/1987 | De Haven et al. | 89/34 |
| 4,727,790 | 3/1988 | De Haven et al. | 89/46 |
| 4,777,863 | 10/1988 | De Haven et al. | 89/47 |
| 4,777,864 | 10/1988 | Siech et al. | 89/45 |
| 4,785,922 | 11/1988 | Kiehart | 188/316 |
| 4,791,851 | 12/1988 | Soner | 89/156 |
| 4,800,924 | 1/1989 | Johnson | 137/625.23 |
| 4,898,757 | 2/1990 | Maix | 428/97 |
| 4,942,802 | 7/1990 | Stoner | 89/191.01 |
| 5,117,735 | 6/1992 | Flashkes | 89/191.01 |
| 5,351,598 | 10/1994 | Schuetz | 89/191.01 |

*Primary Examiner*—Charles T. Jordan
*Assistant Examiner*—Theresa M. Wesson
*Attorney, Agent, or Firm*—Lloyd W. Sadler

[57] ABSTRACT

A weapon system is disclose whose design permits simple reconfiguration of the weapon to perform optimally in many configurations. By reconfigurations, the weapon can be configured to fire a wide variety of cartridges, including but not limited to 7.62×39 mm, 5.45×39 mm, 5.56 NATO, 0.45 ACP, 9 mm, 40 S&W, and 0.300 Magnum. This reconfiguration is accomplished by easily changing the following components: barrel; operating rod, recoil spring, and buffer; gas tube, bolt head, firing pin and extractor; and magazine well. The weapon can be reconfigured to accept a wide variety of cartridge feeding devices, including but not limited to AR15/M16 magazines, AK47 magazines, and a variety of ammunition belts and links. Also, the weapon system can be easily reconfigured to position a cartridge magazine either under the firearm or above the firearm. This is accomplished by an upper receiver design that permits the entire upper receiver to be flipped top to bottom and by use of consistent easy to connect/disconnect mounting points. In sum, this invention permits a single firearm to be simply and easily configured by the operator for a very wide range of purposes, including target shooting, hunting, military, and law enforcement. By making it possible for a user to configure the weapon for different cartridges, this weapon system permits the operator to use the ammunition most affordable, most efficient or most available for a given purpose.

1 Claim, 29 Drawing Sheets

MODULAR, MULTI-CALIBER WEAPON SYSTEM

BACKGROUND OF THE INVENTION

1. Field of the Invention

This invention relates to firearms. Specifically, this invention is primarily a gas operated firearm which can easily be configured to fire a variety of cartridges using a variety of box magazines and belt-feeding devices. Furthermore, this invention can be configured to feed ammunition from either the top or the bottom of the firearm. Also, this invention will permit cocking of the firearm from the left side of the upper receiver with a non-reciprocating cocking handle incorporating a bolt forward assist or a reciprocating cocking handle feature while it is configured to feed from the bottom of the upper receiver. Alternative embodiments of the invention, can permit cocking of the firearm from the right side of the upper receiver.

2. Description of Related Art

Several features of this invention have been considered or used in prior firearm designs.

The H&K Model 21 and 23 series firearms are capable of firing several different cartridges, specifically 7.62 NATO, 5.56 NATO and 7.62×39 mm, by changing out the barrel, magazine well (or belt feed device), and bolt. However, these rifles are recoil/blow-back operated while this invention is gas operated. Furthermore, these rifles do not permit an operator to modify the operating system mass, operating system diameter, length and pressure and/or operating system travel, as does this invention. Such modifications are necessary to solve the problem of poor operating performance which occurs when a firearm is converted to shoot more than one cartridge type.

Adjustable gas systems for rifles are well known in the art. As early as the Browning BAR automatic military rifle (designed in the early 1900s), the amount of gas used to cycle the operating system could be adjusted by restricting or increasing the size of the orifice through which the gas traveled from the barrel to the gas tube to act upon the piston operating rod. Other systems allowed various amounts of gas to bleed from the gas system by allowing the operator to open or close vent holes in the gas system. Early examples of this approach include the FN Model D BAR, and the FN FAL Rifle. Unlike these approaches, this invention is not only gas operated but it has a gas operating system which can be optimized to maximize the performance of the chosen cartridge while minimizing recoil. Additionally, the cyclic rate of the fully automatic versions of the invention to be altered without sacrificing reliability.

The closest known approach for a weapon system which can be fed from the top or the bottom of the firearm, by shifting components to the other side of the receiver is the Stoner 63 and 63A Convertible Weapon System. However, unlike the Stoners, which use only the 5.56 NATO cartridge, this invention permits the use of many of the popular cartridges such as 5.56 NATO, 7.62×39 mm, and 5.45×39 mm. Additionally, the invention permits the use of existing magazines, belts and links for the aforementioned cartridges by the simple change of the magazine well or belt feed device and bolt. While the current embodiment of this invention can fire 7.62×39 mm and 5.45×39 in addition to the 5.56 NATO cartridge. Alternative, presently envisioned embodiments of this invention, will be able to use such other ammunition as 0.45 ACP, 9 mm, 0.40 S&W pistol calibers and magazines and hunting rifle cartridges ranging from 0.223 (5.56 NATO) to 0.300 Winchester Mag. using this changeable operating system and magazine well invention. Additionally, this invention can be fired from a closed-bolt, whether cartridges are fed from the top or the bottom of the receiver. This is essential for civilian use, since open bolt firing systems are not permitted, for civilian ownership, in the United States, because they are too easily converted to fire fully automatically.

Other weapons with the recoil spring located on the operating rod are the Beretta M70 and the SIG 550 series of firearms. The difference between this element of this invention and these firearms is that this invention can use operating rods, recoil springs and buffers, and gas tubes of different dimensions without modifying the receiver. Also, the action of this invention can be cycled from the left hand side of the upper receiver using a non-reciprocating cocking handle to which a forward assist mechanism can be added, or alternatively a reciprocating cocking handle can be employed from either side of the upper receiver. Further, with this invention, the operating systems length of travel, piston diameter, mass, and recoil spring force can be changed to minimize recoil and ensure reliable operation with any given cartridge. Changing these characteristics can also alter the cyclic rate in fully-automatic versions.

For general background material, the reader is directed to U.S. Pat. Nos. 2,951,424, 3,032,882, 3,035,495, 3,045,555, 3,087,270, 3,090,150, 3,198,076, 3,235,997, 3,293,986, 3,455,204, 3,500,718, 3,512,449, 3,517,586, 3,547,001, 3,566,744, 3,683,743, 3,968,750, 4,027,415, 4,213,376, 4,311,081, 4,348,938, 4,625,621, 4,790,231, 4,791,851, 4,872,391, 4,942,802, 5,024,139, 5,050,480, 5,050,481, 5,117,735, 5,370,036 and U.S. Pat. Nos. Des. 188,193 and 192,032. Other related background material can be found in Firearms Assembly 3, published by the National Rifle Association in 1987; Small Arms of the World by Edward Clinton Ezell ($12^{th}$ Revised Ed.), published by Stackpole Books; and Stoner 63A Weapons System Specifications, published by Cadillac Gage Company. Each of the above references is hereby incorporated by reference in its entirety for the material disclosed therein.

SUMMARY OF THE INVENTION

It is desirable to provide a modular, multicaliber weapon system that provides the weapon operator the ability to fire a number of different popular cartridges through the same firearm, where the weapon system can be optimized for each cartridge, where the weapon system can be easily reconfigured in the field, where the weapon system can accept for use existing high capacity magazines and other ammunition feeding devices such as belts or links, and where the ammunition feed subsystem can be reconfigured to feed ammunition from either the top or the bottom of the firearm.

Furthermore, it is desirable to have a weapon system that can be easily reconfigurable to meet a number of applications. For example, for the civilian hunter or target shooter, it is desirable to have a gun which allows the hunter to chose the best caliber for the game the hunter is hunting while using a firearm with which he or she is already familiar. Such a firearm permits a hunter to use the most effective cartridge without the financial expenditure or inconvenience of requiring multiple firearms. Similarly, the hunter can use whichever cartridge is least expensive for practice. Additionally, the user can use the most easily found, therefore most affordable, pre-ban high capacity magazines. For target practice, the weapon operator may desire to shoot a cartridge which provides less recoil, and/or a heavier, stiffer barrel, than he or she would normally use for hunting.

For the military/law enforcement use, it is very desirable to have a weapon system which permits a soldier/policeman to convert his or her firearm to use available ammunition and feeding devices. This is particularly true in many foreign countries where the quality and quantity of available ammunition can be very limiting. Also, a firearm that can be reconfigured for a wide range of uses, from a medium machine gun, to an assault rifle, to a sniper rifle, accepting ammunition from belt-feeding devices or magazines, while remaining a single familiar weapon is most desirable. Such a weapon is logistically much easier to support, easier to train on, and much more flexible than currently exists in the weapons system art.

It is also desirable to have a weapon system that is reconfigurable as a developmental test bed for the development of new firearms or ammunition.

Accordingly, it is the primary object of this invention to provide a weapon system that is capable of being easily reconfigurable to accept a wide variety of cartridges.

Another object of this invention is to provide a weapon system that can be easily optimized for the selected cartridge, thereby ensuring proper function and minimized recoil.

It is a further objective of this invention to provide a weapon system that permits the use of a wide range of popular cartridge feeding devices, including but not limited to box and drum magazines, and ammunition belts and links.

It is a further objective of this invention to provide a weapon system that permits the use of existing high capacity magazines, belts, and links.

It is a further objective of this invention to provide a weapon system that can be fired from a closed bolt, because open bolt firing systems are not allowed in the civilian market in the United States.

It is a further objective of this invention to provide a weapon system that has a gas optimized operating system, which can be adjusted for varying cartridges and operating conditions.

It is a further objective of this invention to provide a weapon system that can receive the ammunition feed from either the top side of the firearm or the bottom side of the firearm.

It is a further objective of this invention to provide a weapon system that has a non-reciprocating or reciprocating cocking handle on the left side of the weapon, to be more ergonomic for right handed shooting.

These and other objectives of this invention are achieved by this invention which permits the operator to select the cartridge which he or she wishes to fire; to choose the appropriate barrel, inserting it into its hole in the upper receiver; inserting the operating rod with spring into the upper receiver and locking it into place; selecting the corresponding gas tube and inserting and locking it into place in the receiver; attaching the magazine well; attaching the lower receiver to its forward mounting point; installing the correct bolt, firing pin and firing pin spring for the selected cartridge onto the bolt carrier; sliding the bolt/carrier assembly into the rear end of the upper receiver and attaching it securely to the operating rod; rotating the lower receiver to its rear mounting point and securing it; calibrating the sights; inserting the proper magazine with the selected cartridges; drawing back the bolt carrier and bringing the cartridge into the chamber. The weapon system is now ready to fire. In sum, the objectives of this invention are accomplished by this weapon system invention which allows an operator to choose the operating system which optimizes the function of the firearm for the selected cartridge.

DETAILED DESCRIPTION OF THE INVENTION

Figure 1:
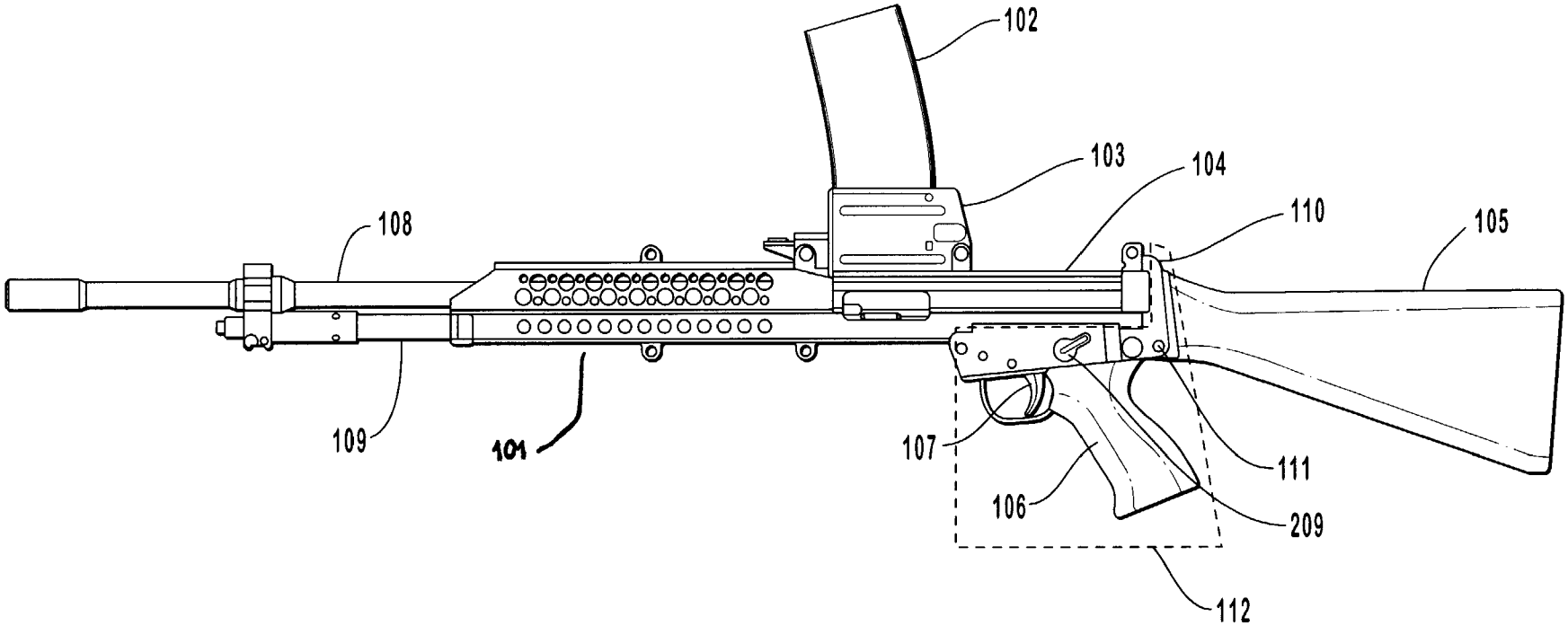
FIG. 1 is a side view of one preferred embodiment of the invention. This view shows the weapon system in a top feed configuration.

FIG. 1 depicts the side view of the preferred embodiment of the invention in the top ammunition feed configuration 101. The upper receiver 104 provides a frame on which most of the major component parts of the invention attach. In the preferred embodiment of the invention, the upper receiver 104 is made from sheet steel. Although, alternatively the upper receiver 104 could be made from a metal casting or a composite material. The magazine well 103 attaches to the upper receiver 104 via front and rear holes which match similar holes on the upper receiver 104. Detent pins or screws are used in the preferred embodiment to hold the magazine well 103 in place. Typically, the magazine well is made of sheet steel to which machined and/or sheet steel parts are welded. Other methods of attachment of the magazine well 103 to the upper receiver 104 are well known in the art, including bolts, pins, and clips. Also, alternatively, the magazine well 103 could be composed of an injection molded composite material, such as ABS plastic, with inserted molded metal attachment pieces.

The magazine 102 is shown inserted into the magazine well 103. Magazines 102 are subset of what are referred to as feeding devices, or more specifically, ammunition feeding devices. Magazines are well known in the art and typically consist of a magazine body, a spring and follower and a bottom plate. Magazines 102 hold the ammunition under spring loaded tension thereby pushing cartridges into the firearm when appropriate.

A buttstock 105 provides a support point against which the operator's shoulder is placed. A buttstock 105 is an optional attachment to the invention and can be easily attached or removed from its mounting points 110 and 111. Typically the buttstock 105 is composed of wood, self-skinning foam, fiberglass, or in the preferred embodiment, injection molded plastic with fiber reinforcement.

The lower receiver 112 is shown within the dashed lines on FIG. 1. On the lower receiver 112 mounts the pistol grip 106, the buttstock 105, the hammer, the trigger 107, the disconnect, the safety selector, including the associated springs and axis pins. The means of attaching these components to the lower receiver 112 is well known in the art. An exploded view of the interior components of the lower receiver is given in FIG. 21.

The trigger 107 is shown attached to the lower receiver. The trigger is typically made from cast, sintered or injection molded metal.

The barrel 108 is shown attached to the upper receiver 104. In the preferred embodiment of the invention the barrel 104 is attached at the trunion and is held in place by a barrel release pin. The barrel 108 is typically made from steel or can be a composite of steel overwrapped with graphite fiber and epoxy resin.

The gas tube 109 directs gasses from the barrel 108 to the piston of the operating rod. The rear end of the gas tube 109 attaches to a hole in the top of the trunion. The gas tube 109 is tapered near its front end, the end within the upper receiver 104, which allows the gas tube 109 to be installed and removed without tools, while providing good support for the barrel 108 via the cylindrical section of the gas take off.

Figure 2:
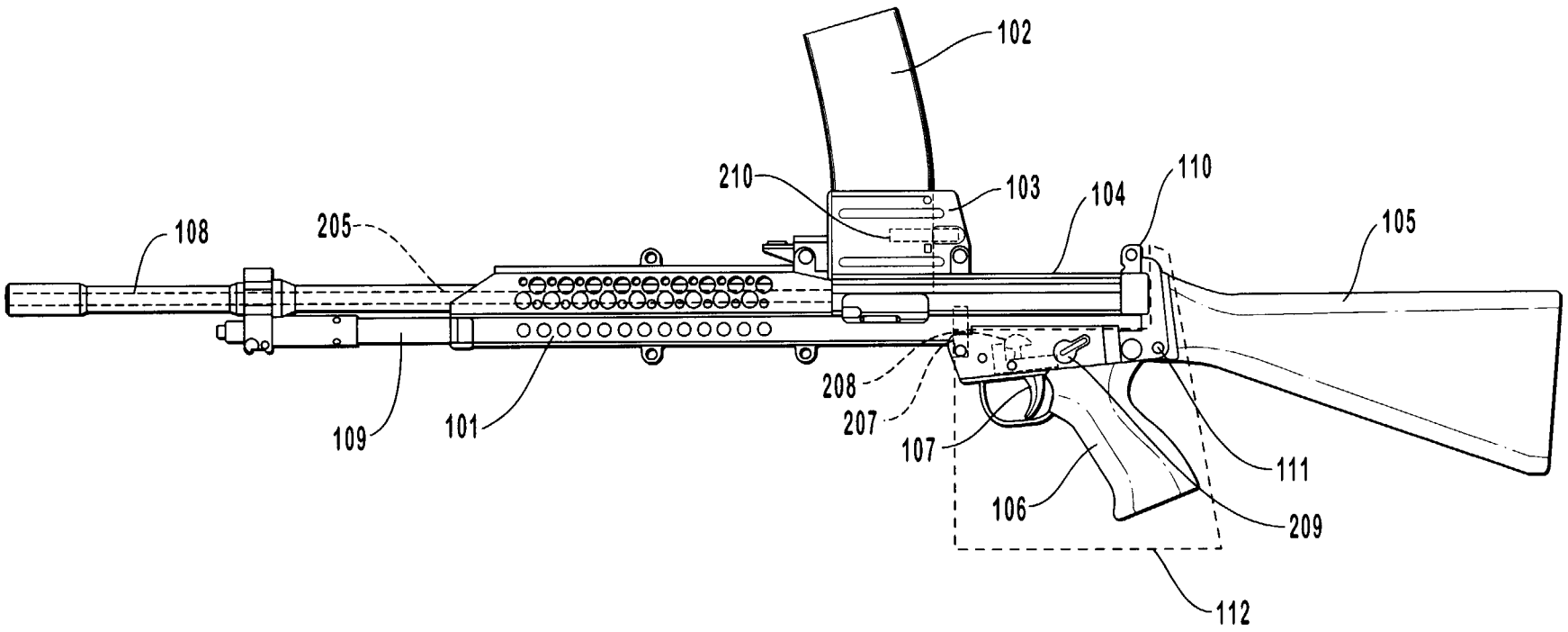
FIG. 2 is a side view of one embodiment of the invention. This view is a cut-away view shows the internal components of the invention, with a prior version of the trigger assembly components.

FIG. 2 shows a cut-away view of one embodiment of the invention. The upper receiver 104 is shown as is the lower receiver 112. Within the lower receiver 112 is shown the hammer 207, the interior trigger components 208 and the safety selector switch 209. In the automatic version of the invention the safety selector switch 209 serves as the automatic/semi-automatic selector switch. The interior of the barrel 205 is shown extending within the upper receiver 104. Also the magazine catch 210 is shown within the magazine 102. The magazine catch controls the insertion of magazine into the firearm 101.

Figure 3:
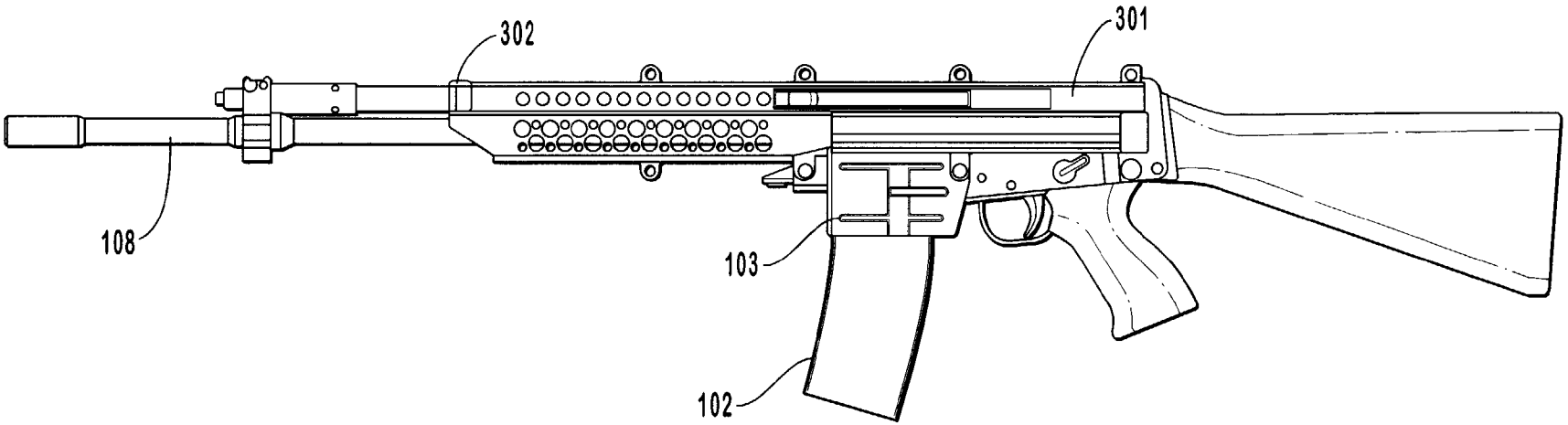
FIG. 3 is a side view of an alternative preferred configuration of the invention. This view shows the weapon system in a bottom feed configuration.
Figure 22:
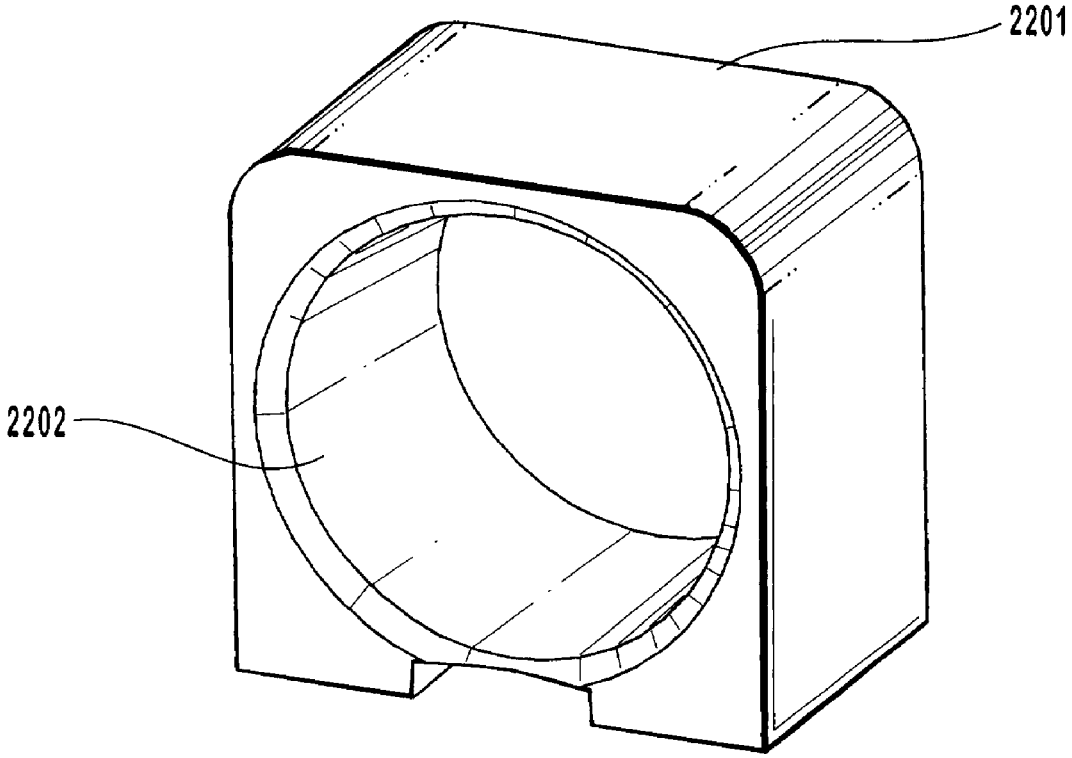
FIG. 22 is a detailed view of the forward trunion.

FIG. 3 shows an alternative configuration of the invention where the upper receiver is flipped top to bottom permitting the magazine well 103 to mount below the firearm. The magazine 102 is shown inserted within the magazine well 103. The forward trunion 302 is shown holding the gas tube 108 in place. A more detailed drawing of the preferred embodiment of the forward trunion is shown in FIG. 22.

Figure 4:
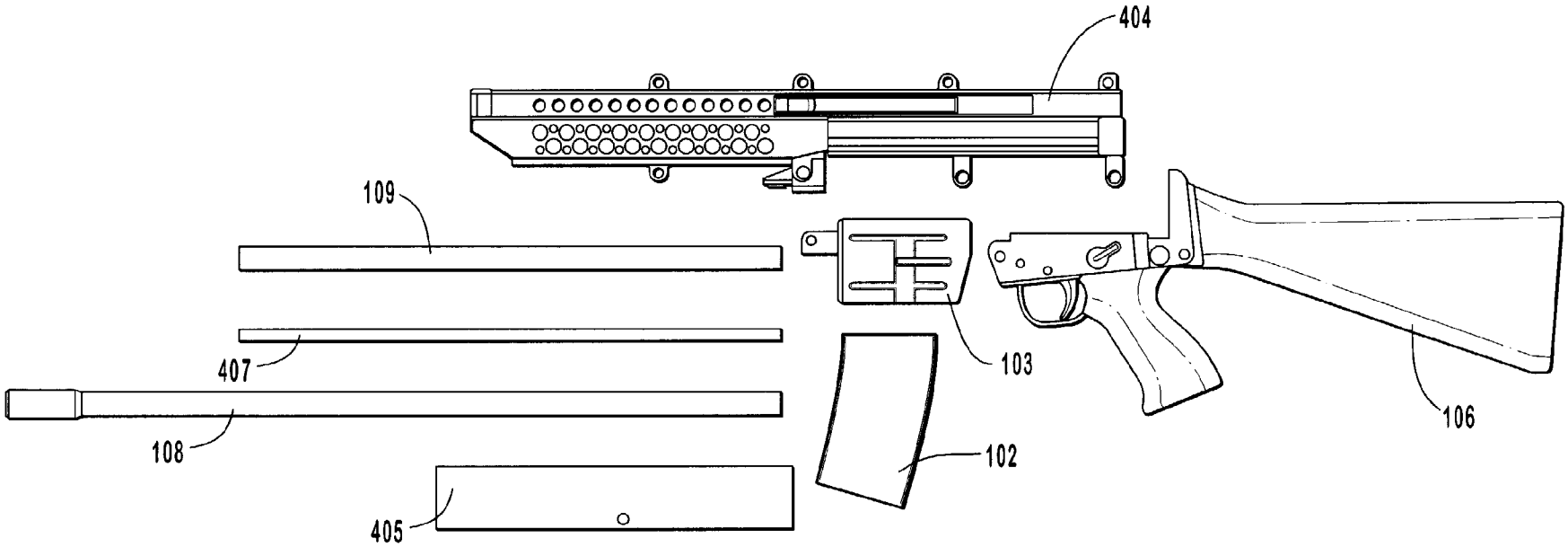
FIG. 4 is an exploded view of the alternative preferred configuration of the invention, showing each major component subassembly of the invention in isolation as well as in proximity to the other subassemblies.
Figure 25:
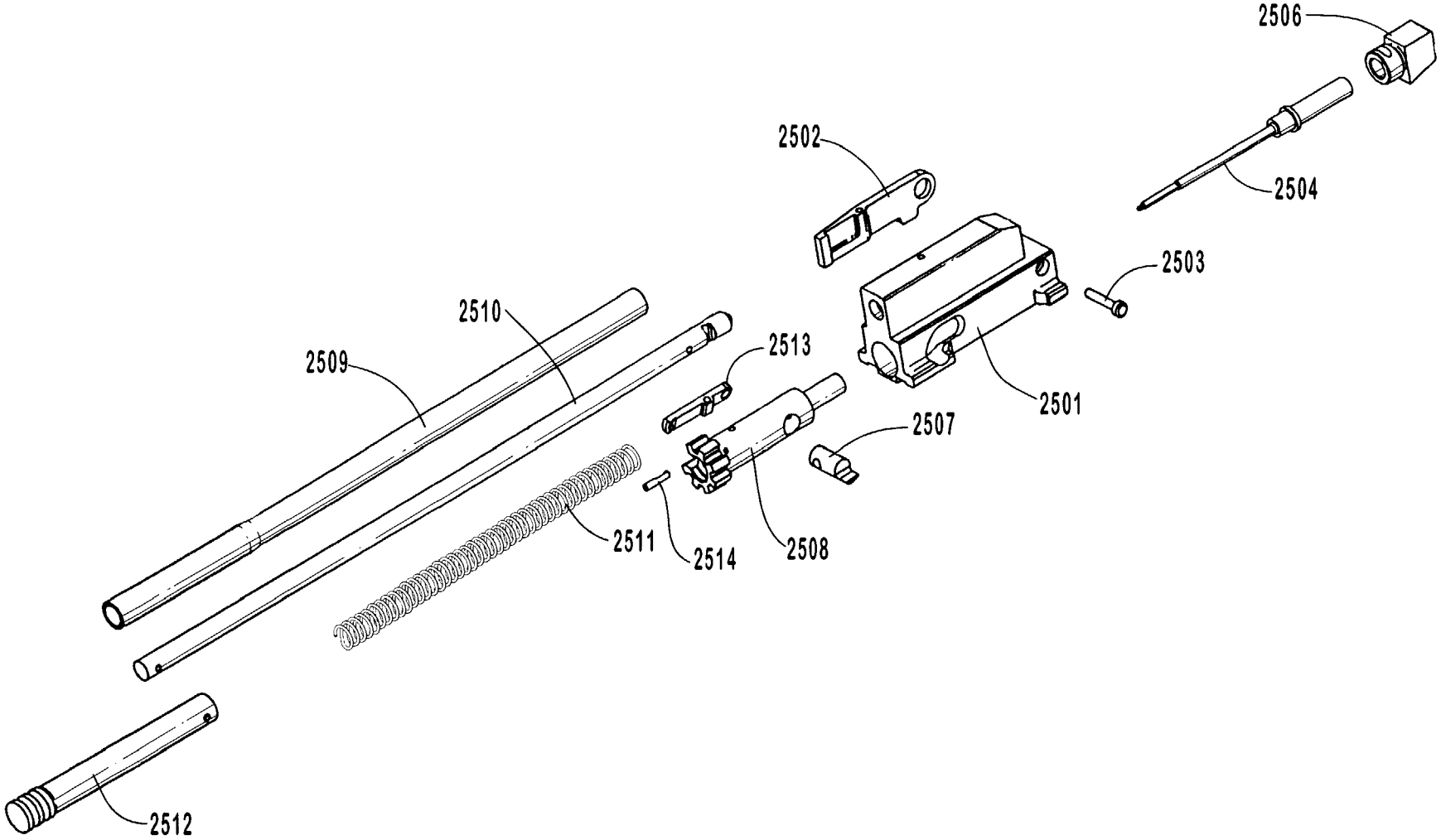
FIG. 25 is an exploded left view of the operating system.
Figure 26:
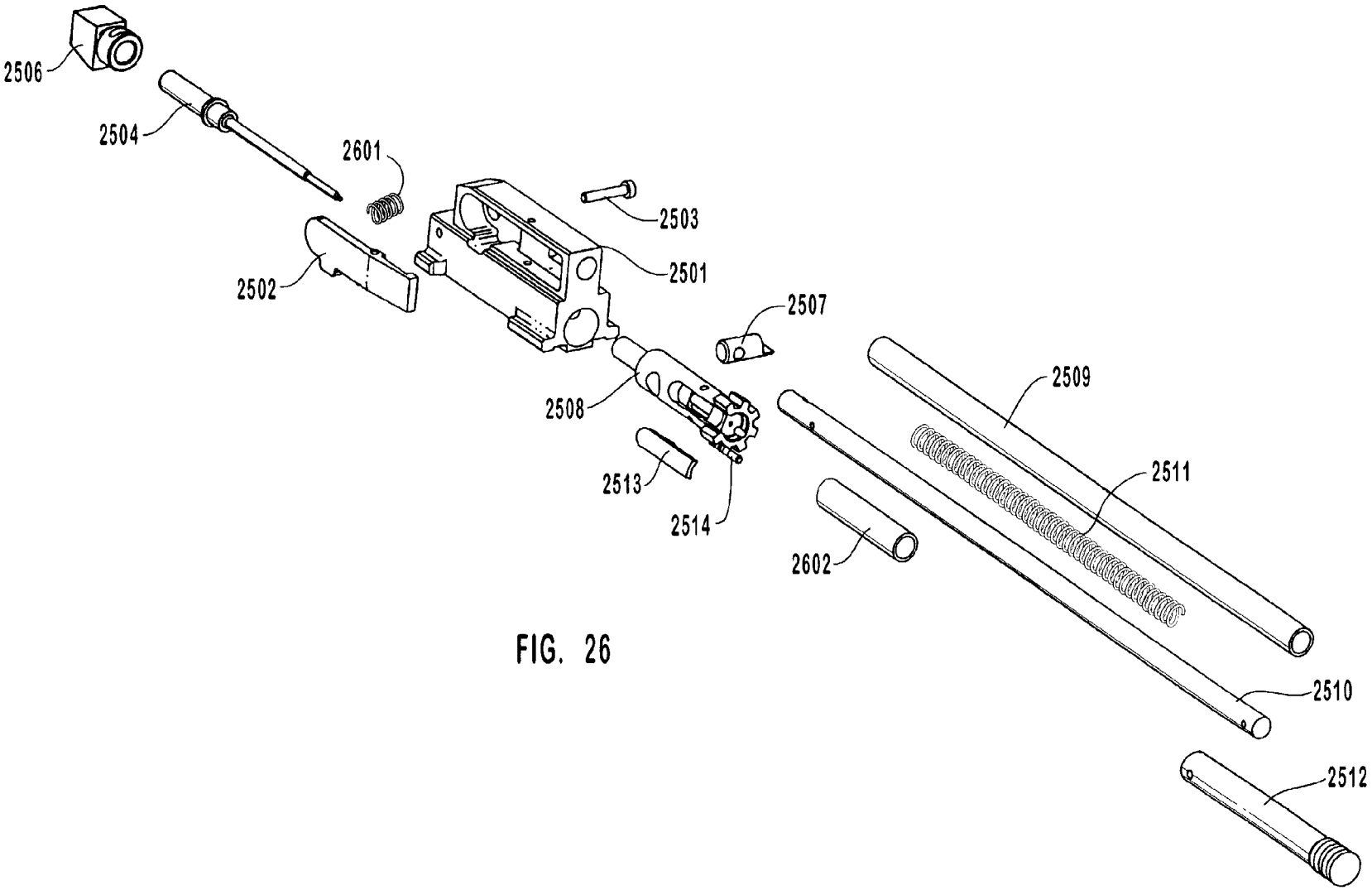
FIG. 26 is an exploded right view of the operating system.

FIG. 4 shows an exploded view of the alternative configuration of the firearm invention. This figure shows the handguard 405 as well as the operating rod 407. Additional detail on the operating rod is shown in FIGS. 25 and 26.

Figure 5:
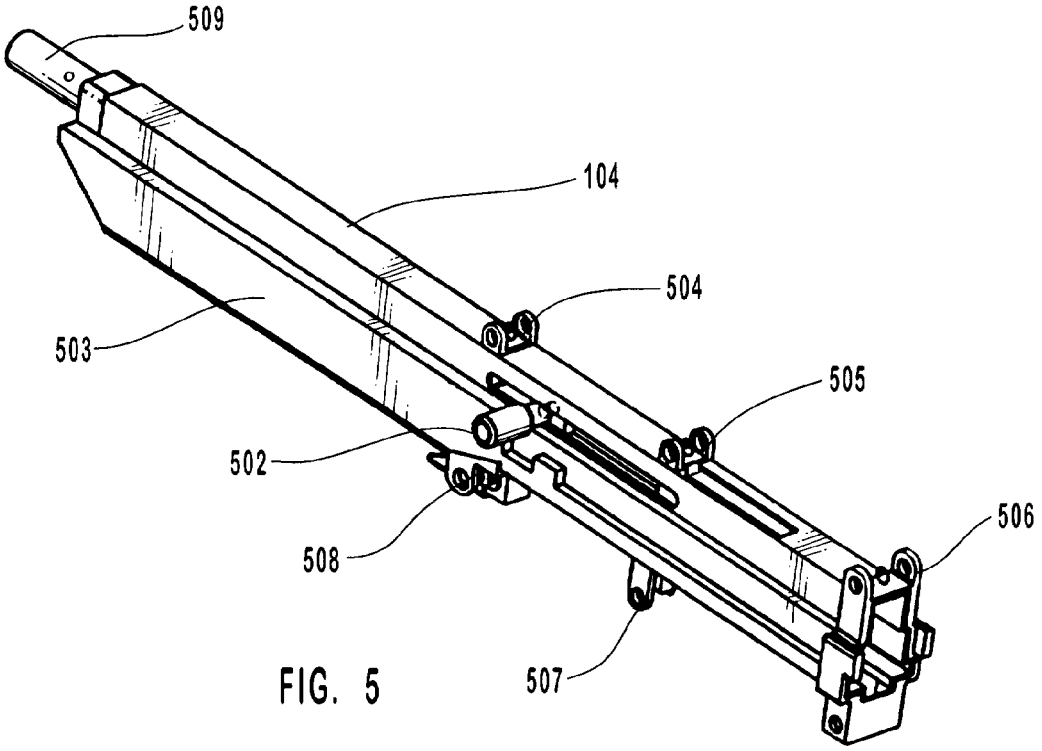
FIG. 5 is a left side view of the upper receiver showing the non-reciprocating cocking handle.

FIG. 5 is a detail drawing of the left side of the upper receiver 104. The cocking handle assembly 502 is shown positioned on the left side 503 of the upper receiver 104. The front mounting points of the upper receiver 504, and 508 are located on the trunion. The rear attachment points of the upper receiver 506 is located on the rear support bracket. While the middle attachment points of the upper receiver 505 and 507 are shown on the top and bottom respectively of the upper receiver 104. The end of the gas tube 509 is shown extending from the end of the upper receiver 104.

Figure 6:
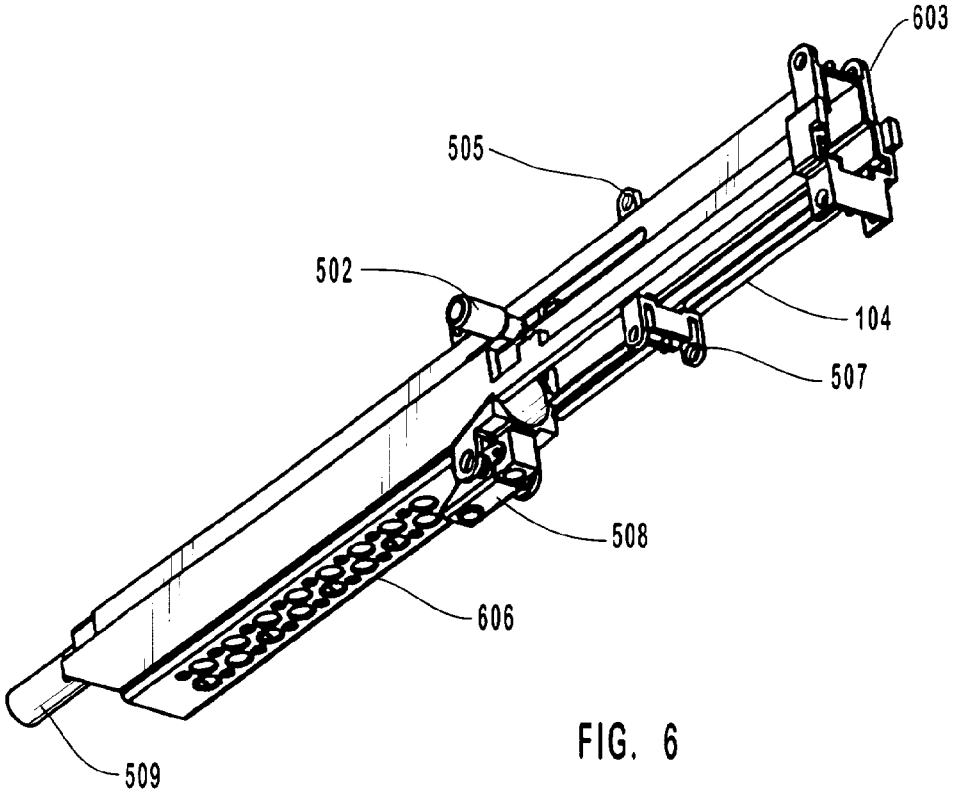
FIG. 6 is a left-below view of the upper receiver showing the magazine well, and the lower receiver attachment points and the main trunion.

FIG. 6 provides the left-below view of the upper receiver 104. The bottom of the upper receiver 104 is shown as well as the back of the upper receiver 603.

Figure 7:
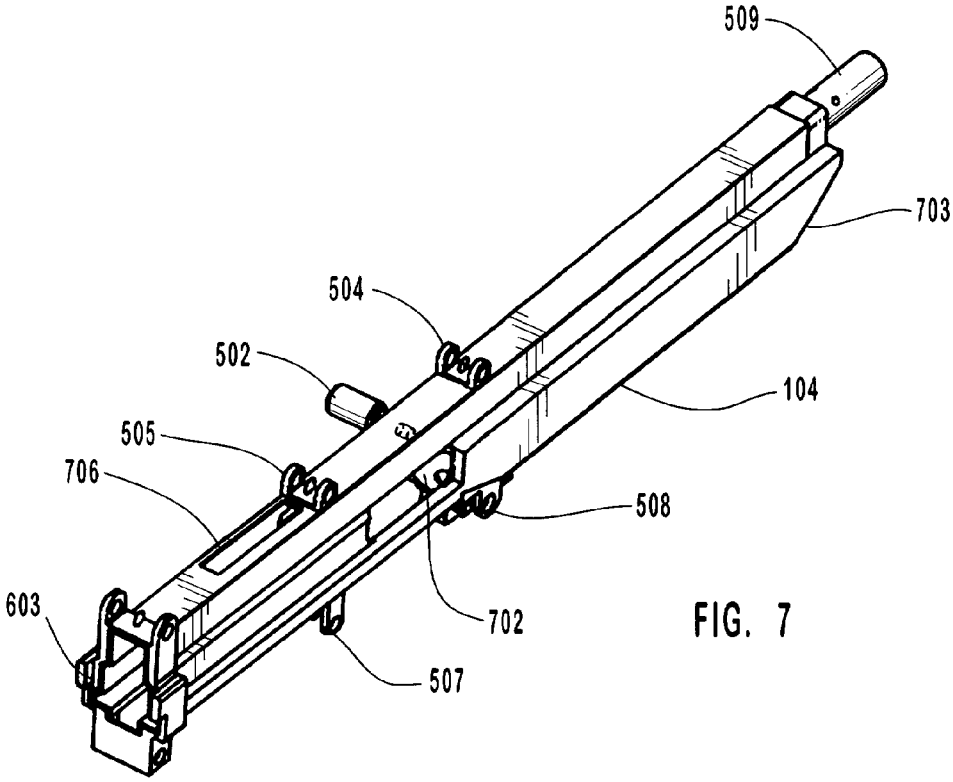
FIG. 7 is right side view of the upper receiver showing the ejection port.

FIG. 7 is a right side view of the upper receiver 104. This view shows the ejection port 702 which is positioned on the right side 703 of the upper receiver 104. The hammer slot 706 is provided in the top of the upper receiver 104 to allow the hammer of the fire control mechanism to rotate and strike the firing pin.

Figure 8:
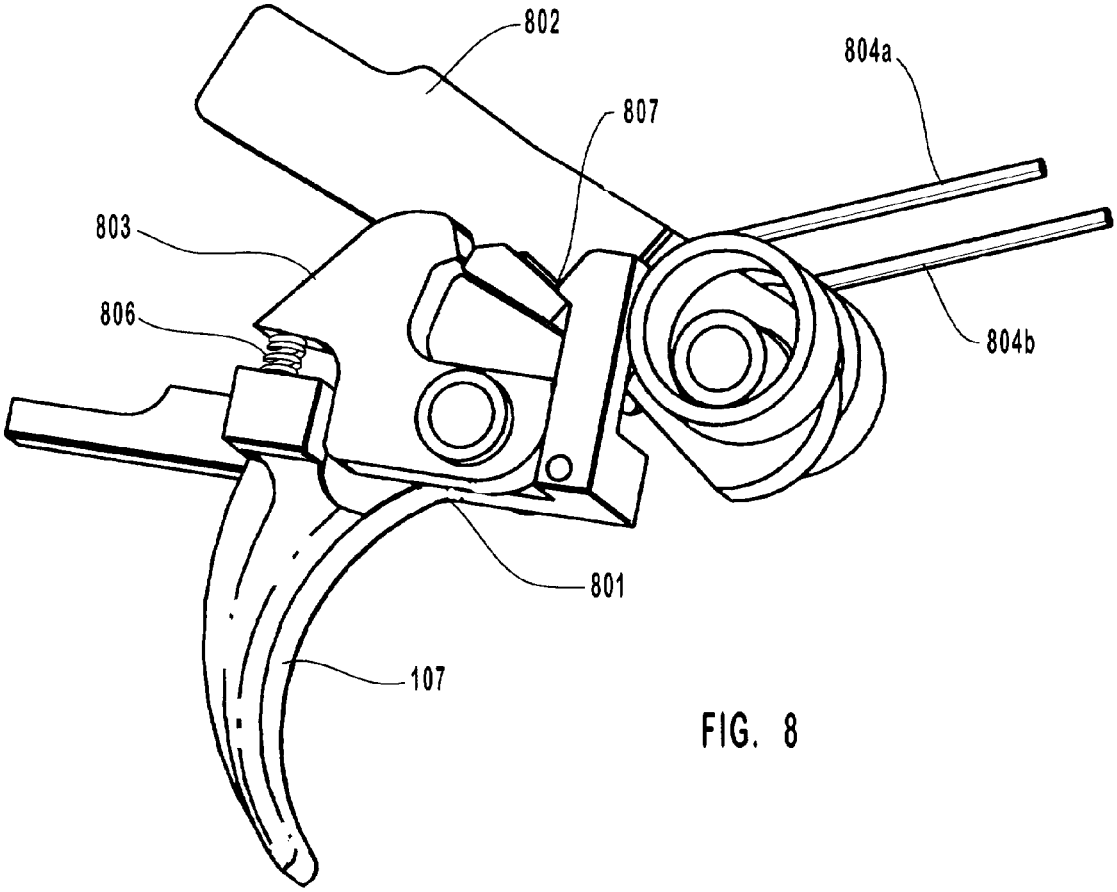
FIG. 8 shows the fire control components of the trigger assembly group.

FIG. 8 shows the fire control components of the trigger group 801. The trigger 107 is pivotally connected to the hammer 802. A trigger disconnect 803 is provided to catch the hammer in the event pressure is not taken off the trigger 107. When pressure from the trigger 107 is released, the trigger sear 807 will catch the hammer 802. A a trigger spring is provided, 804, as well as a disconnect spring 806.

Figure 9:
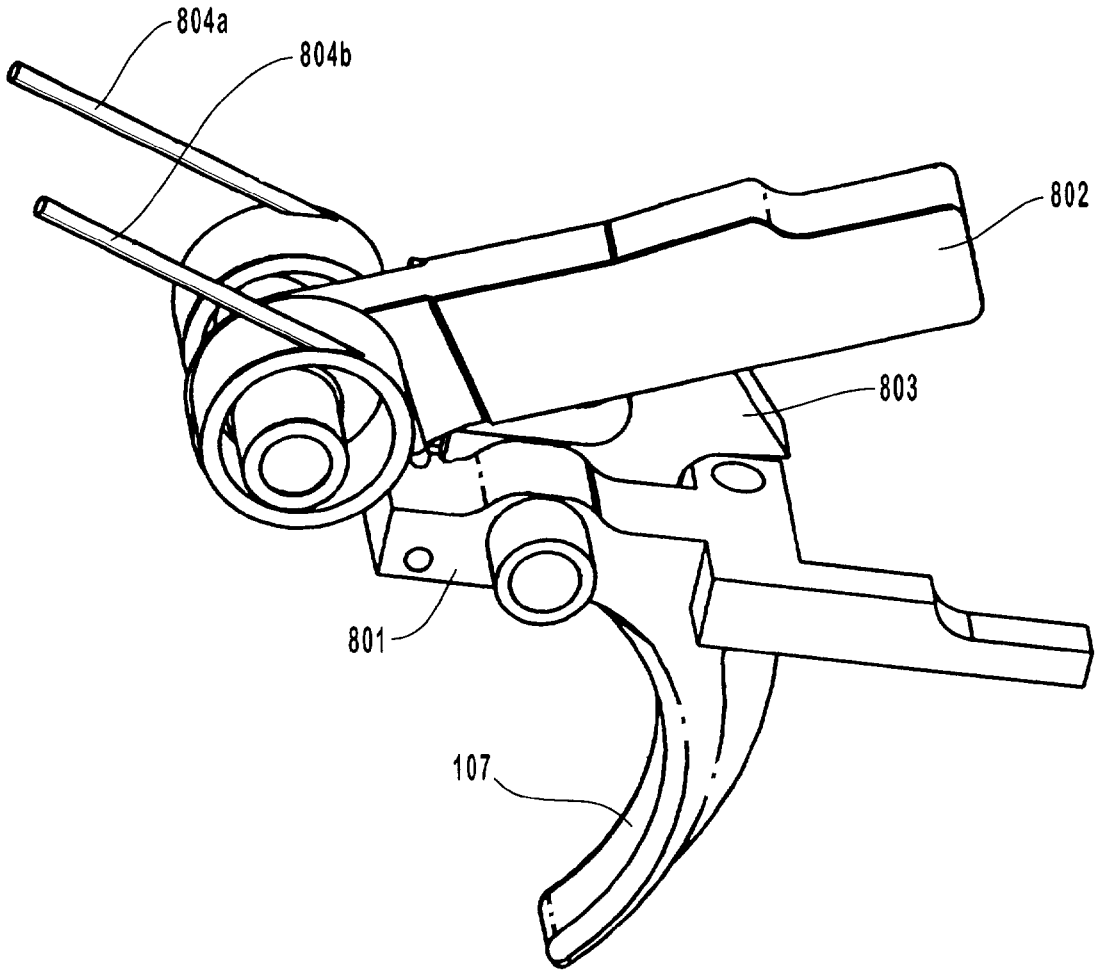
FIG. 9 is a left side view of the trigger mechanism.

FIG. 9 is the left view of the trigger group shown in FIG. 8.

Figure 10:
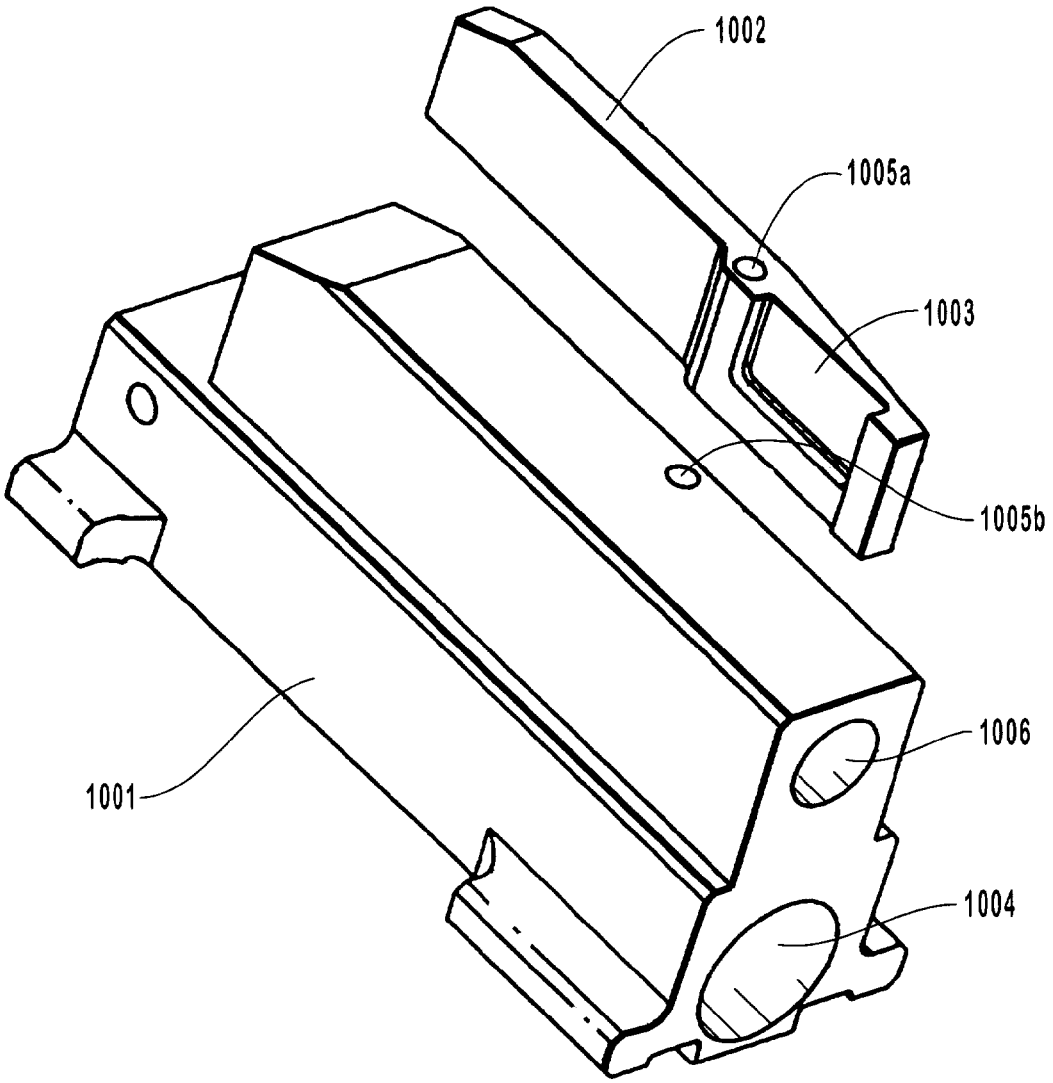
FIG. 10 is a left side view of the bolt carrier.

FIG. 10 is the left side view of the bolt carrier 1001. The operating rod catch 1002 is provided on the top of the bolt carrier 1001, pivotally connected via a pivot pin hole 1005*a*, 1005*b*. The opposite side of the operating rod catch 1003 is shown. Below the operation rod catch 1002 is provided a recessed area for the passage of the operating rod 1006 and a bolt hole 1004.

Figure 11:
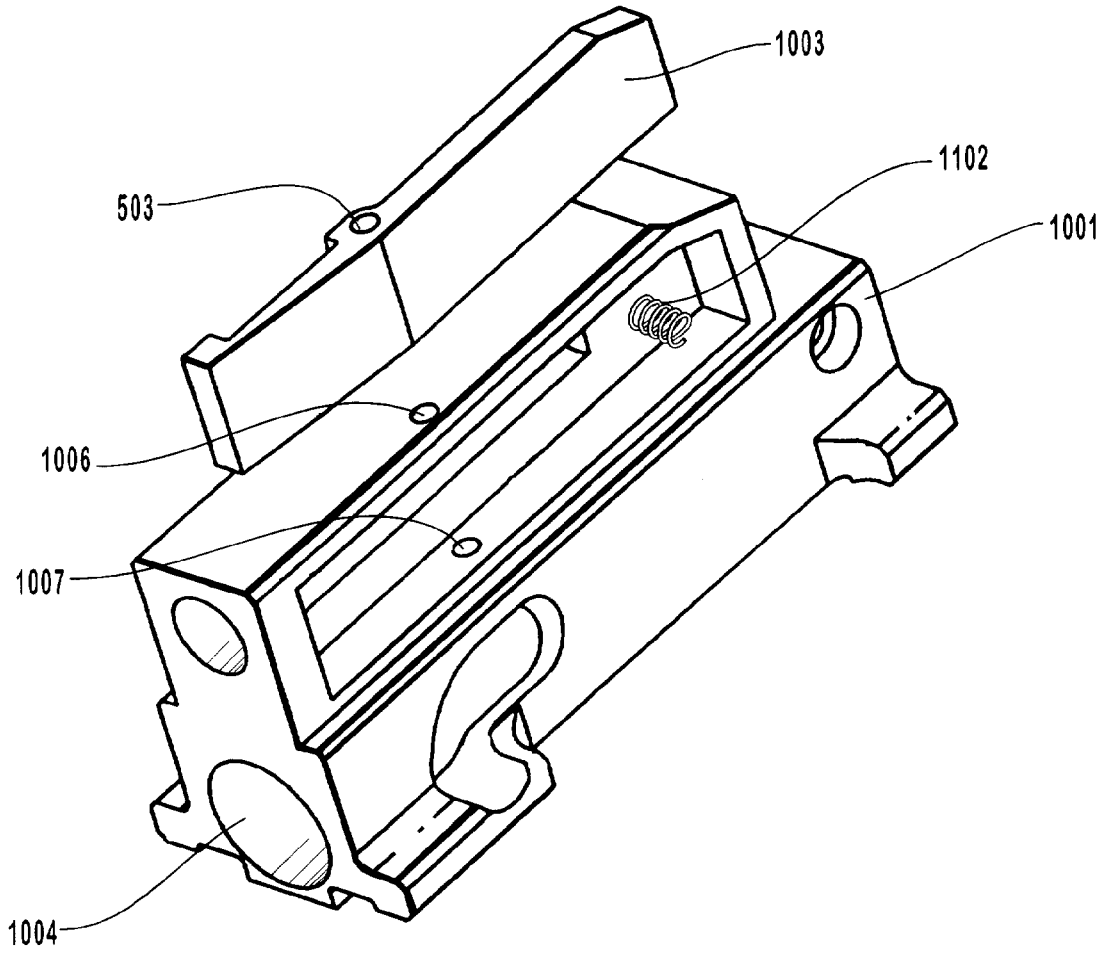
FIG. 11 is a right side view of the bolt carrier.

FIG. 11 is the right side view of the bolt carrier 1001. The operating rod catch spring is shown 1102.

Figure 12:
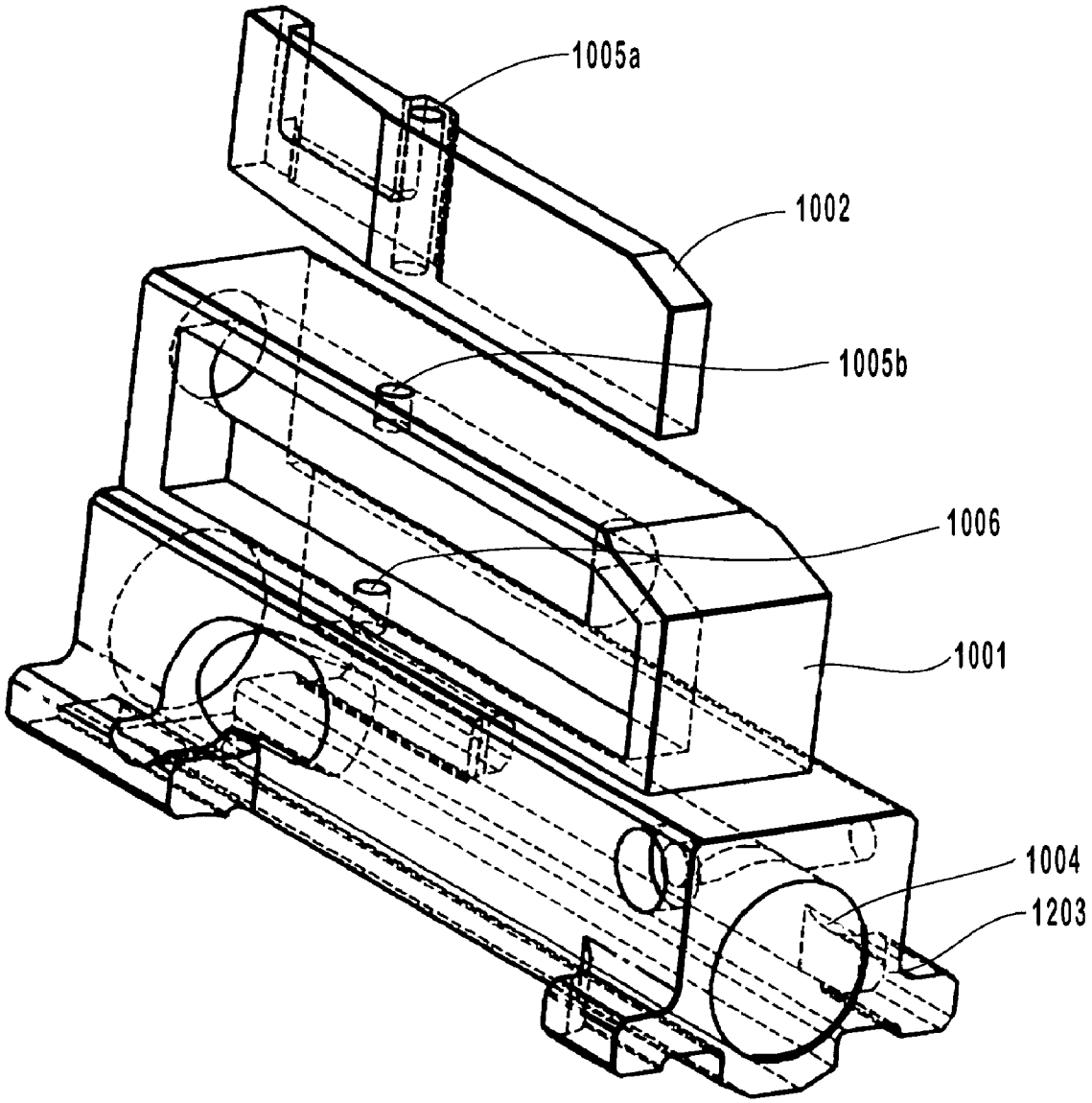
FIG. 12 is a cut-away view of the right side of the bolt carrier.

FIG. 12 is a cut-away view of the right side of the bolt carrier. This view shows the pivot pin hole 1202 which fits within pivot pin hole 1005*a* and 1005*b*. The bolt carrier guides 1203 are also shown where they interact with the bolt as it passes through the bolt hole 1004.

Figure 13:
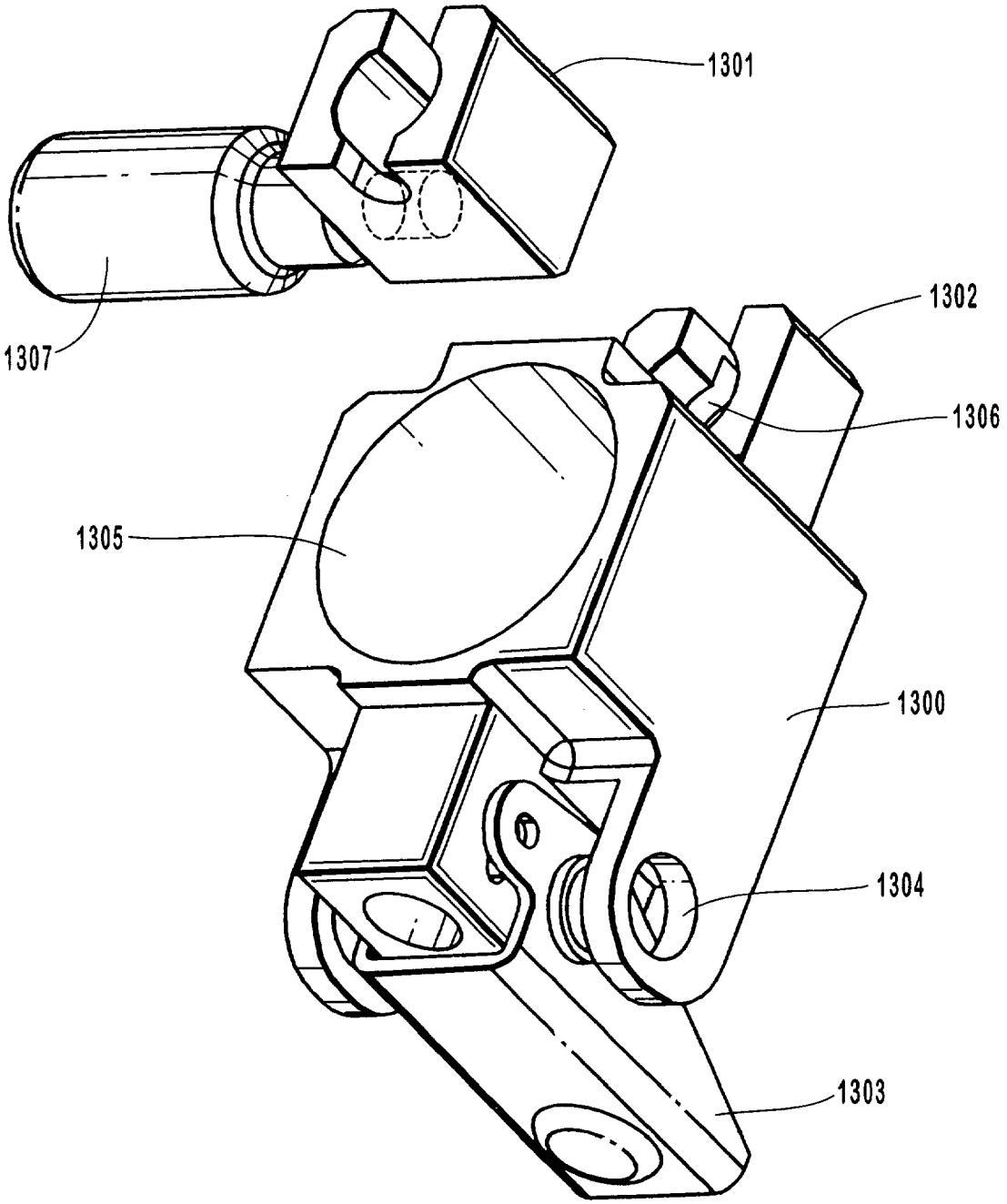
FIG. 13 is a lower right side view of the main trunion and the cocking piece

FIG. 13 is a lower right side view of the trunion and the bolt carrier. The cocking piece 1301 is shown with the cocking handle 1307. The trunion 1302 holds both the barrel 108 in the barrel hole 1305 and the gas tube 109 in the gas tube hole 1306. The trunion 1302 is the focal point of the invention and is the component that permits the invention to be reconfigurable. The magazine well attachment hole is shown 1304 as is the barrel release lever 1303. When the barrel release lever 1303 is depressed the barrel release pin is withdrawn and then the barrel 108 is free to slide out of the upper receiver 104.

Figure 14:
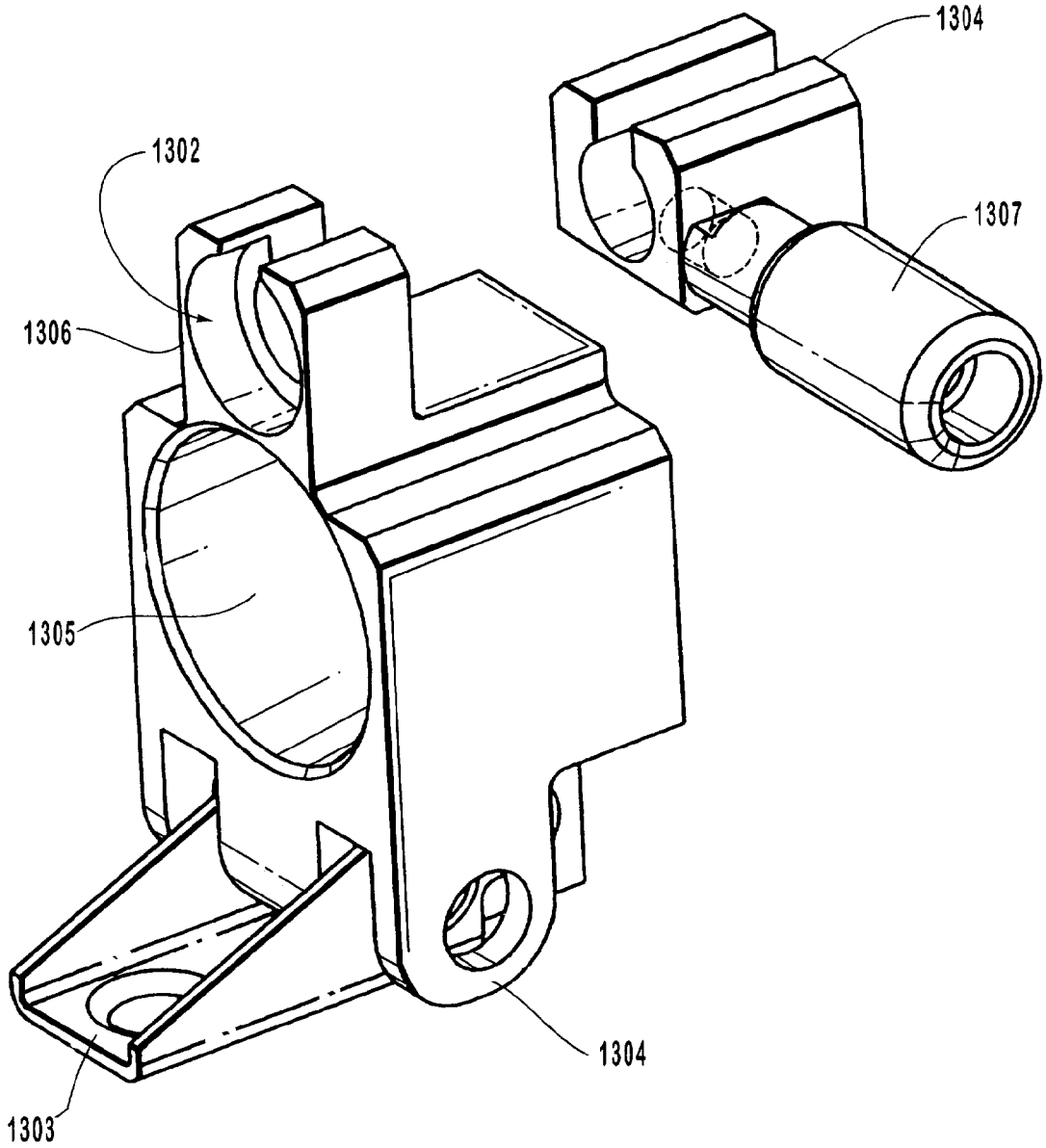
FIG. 14 is an upper left side view of the main trunion and the cocking piece.

FIG. 14 is the upper left side view of the main trunion and the cocking piece.

Figure 15:
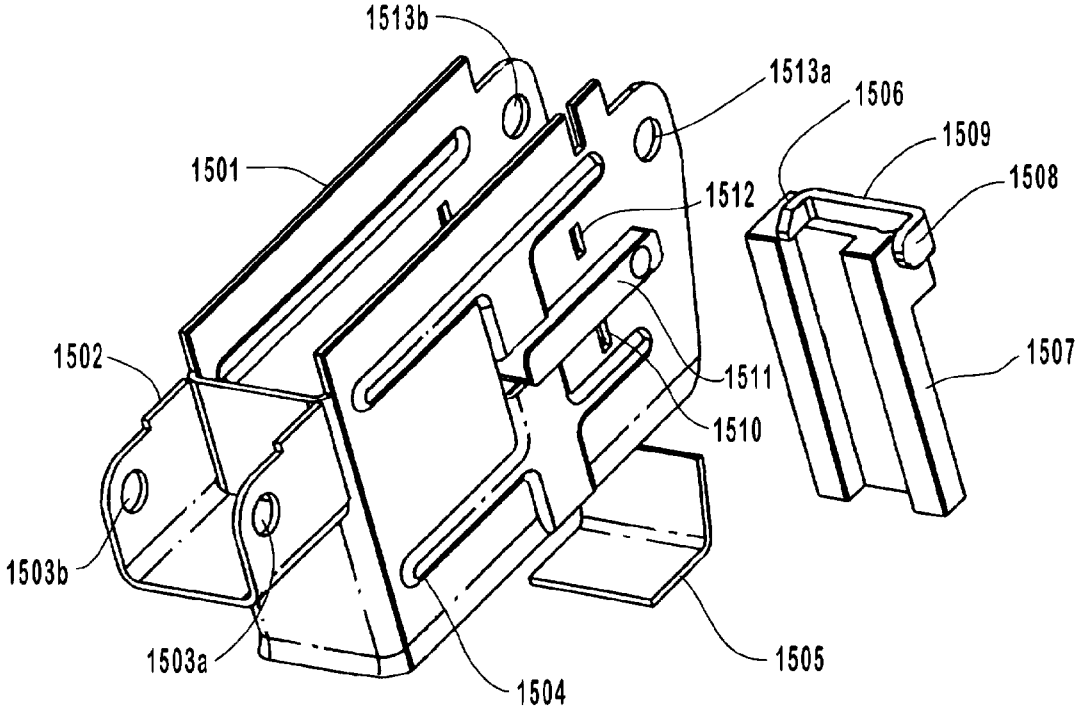
FIG. 15 is a left exploded view of the modular magazine well designed to accept AR15/M16 magazines.

FIG. 15 is the left exploded view of the modular magazine well designed to accept AR15/M16 magazines. The magazine well body 1501 is shown connected to the magazine well front mount 1502. Magazine well front mounting holes 1503*a* and 1503*b* are provided. Magazine well raised areas 1504 are provided. A magazine well back cover 1505 is shown as is the magazine well back 1507. The magazine well back 1507 includes a bolt hold open device lever 1508, the bolt contact point 1509 and the magazine follower contact point 1506. Weld slots 1510 and 1512 are shown as a magazine catch 1511. Magazine well rear attachment holes 1513*a* and 1513*b* provide mounting points.

Figure 16:
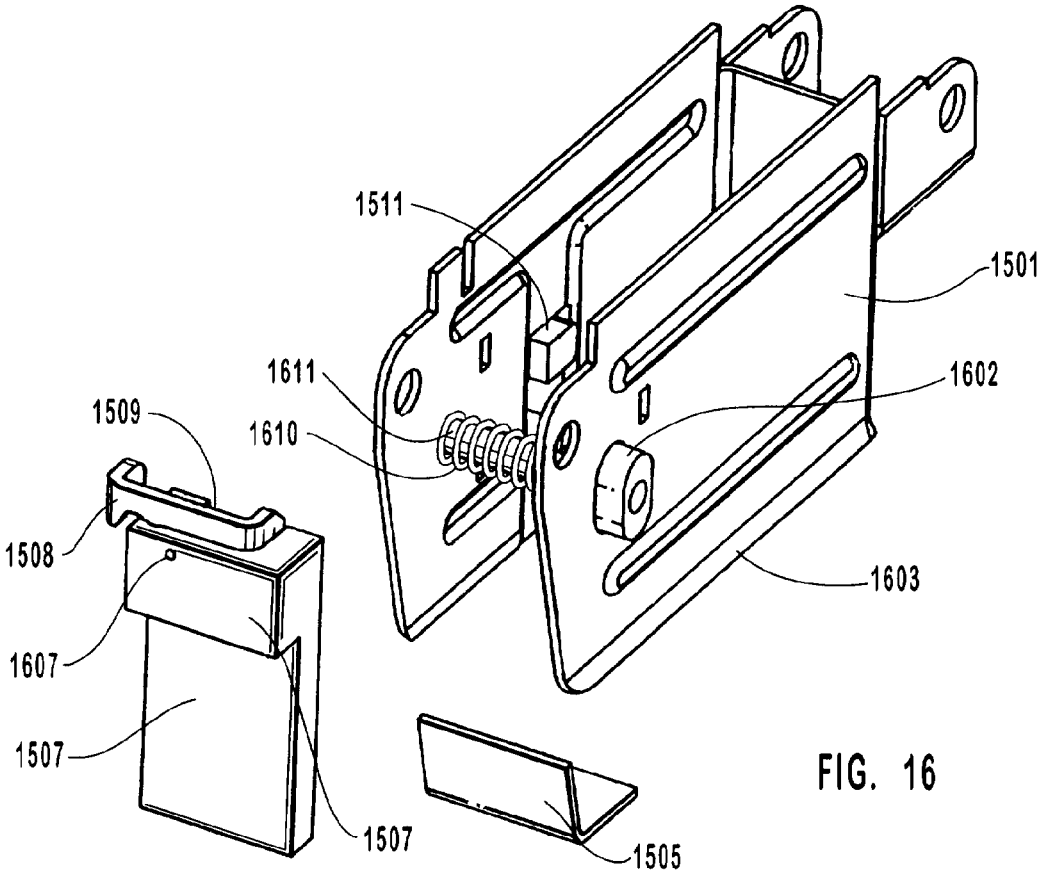
FIG. 16 is a right exploded view of the modular magazine well designed to accept AR15/M16 magazines.

FIG. 16 shows a right side exploded view of the modular magazine well designed to accept AR15/M16 magazines. This view shows the flared edge of the magazine well body 1603 as well as the magazine release button 1602. The magazine release shaft 1611 with magazine release shaft spring 1610 are shown on the release shaft 1611. A Bolt Hold Open Device (BHOD) axis pin hole 1607 is provided for attachment of the magazine wall back 1507.

Figure 17:
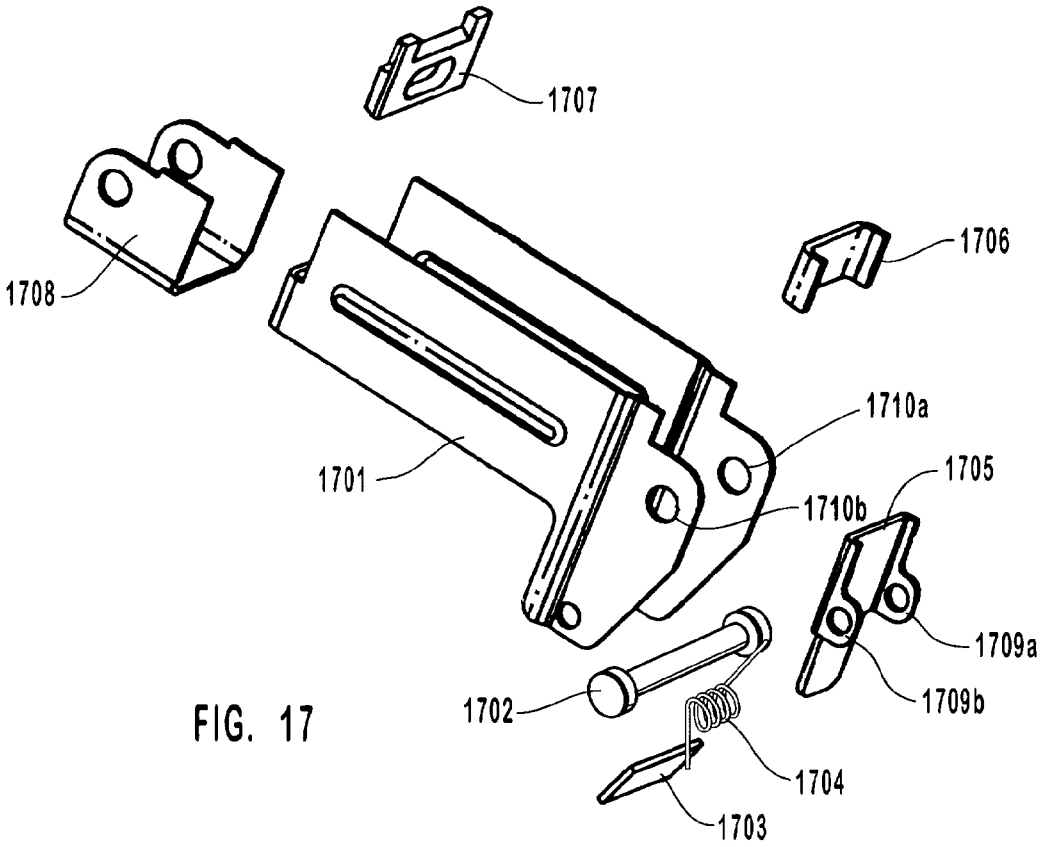
FIG. 17 is a left exploded view of the modular magazine well designed to accept AK47 and AK74 magazines and drums.

FIG. 17 shows the left exploded view of the modular magazine mount designed to accept AK47 and AK74 magazines and drums. The magazine well body 1701 is connectable to magazine well front mount 1708. A magazine well front attachment and feed surface 1707 fits between the magazine well body 1701 and the front mount 1708. A rear mounting point 1706 fits onto the rear of the well body 1701. A magazine release lever 1705 is held onto the well body 1701 by a magazine release pivot pin 1702 and a magazine release spring 1704 which fit through the holes 1709*a*, 1709*b*, and 1711. A magazine back cover 1703 fits below and behind the well body 1701.

Figure 18:
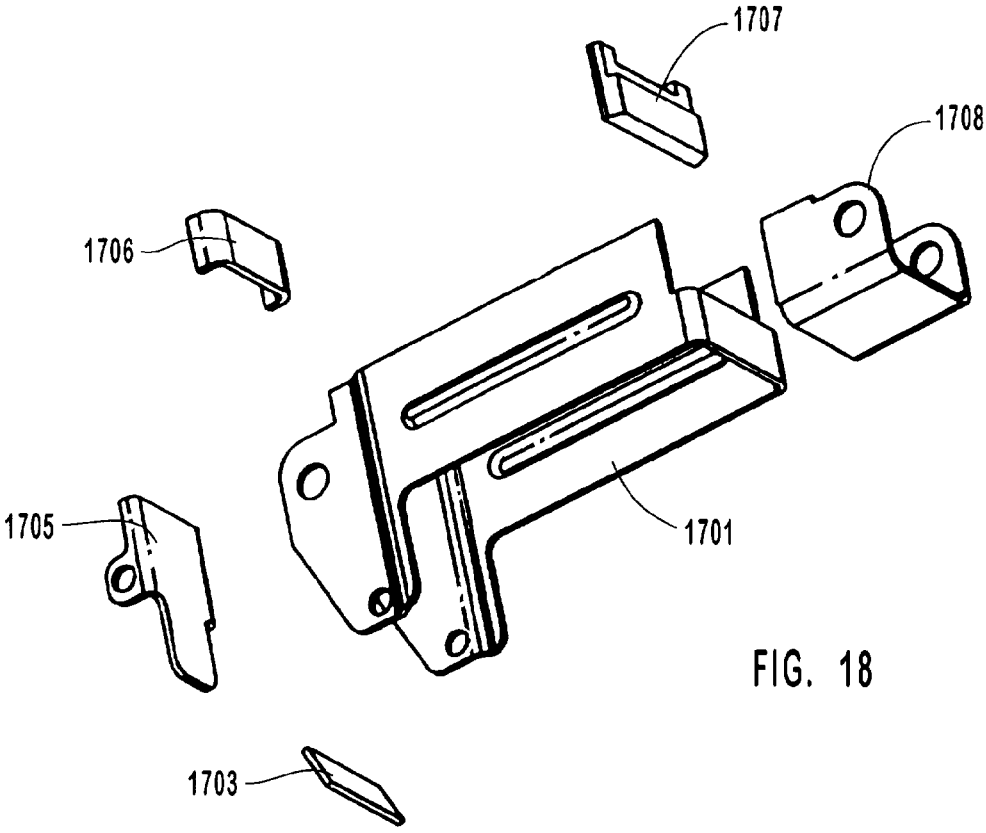
FIG. 18 is a right exploded view of the modular magazine well designed to accept AK47 and AK74 magazines and drums.

FIG. 18 is a right view of the modular magazine well designed to accept AK47 and AK74 magazines and drums and is provide to give the view an alternative view of the this magazine well.

Figure 19:
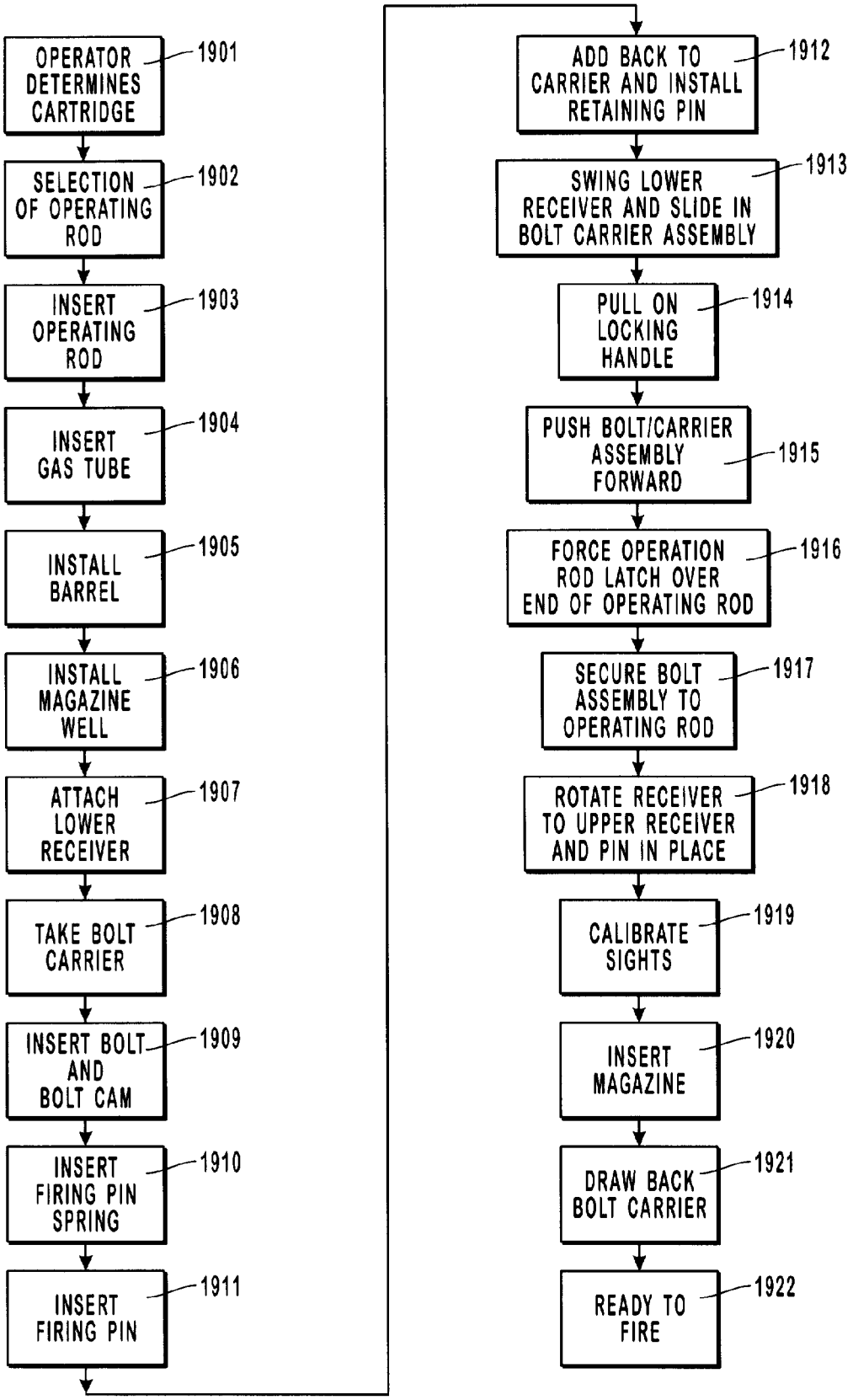
FIG. 19 is a method flow diagram showing the assembly/configuration steps of the invention.

FIG. 19 is method flow diagram showing the assembly steps of the invention. First, the operator decides which cartridge he or she wishes to shoot for his or her intended purpose 1901. Next, the appropriate operating rod is selected 1902. The operating rod selection includes the piston head, the recoil spring and optionally the buffer. With the upper receiver held with the cocking handle all the way forward, the operating rod is inserted 1903 into a hole in the upper receiver and then the operating rod is rotated from 90 to 180 degrees to lock it into place on the cocking piece.

Next, the corresponding gas tube is inserted into its hole and locked into place 1904. At this point the correctly chambered barrel can be installed 1905 into its hole in the receiver. It is locked into place by its pin or some other equivalent attachment device.

Next, the magazine well is pushed into its brackets and a retaining pin is added to its front mounting point 1906. Now, the lower receiver can be attached 1907 to its forward mounting point and a retaining pin is pushed through the rear mounting point of the magazine well and the front mounting point of the lower receiver. The lower receiver can now be rotated downward to allow access to the rear of the upper receiver or can be swung upward to close it.

Next, the operator installs the correct bolt carrier 1908 including the extractor and ejector. The firing pin spring 1910 and firing pin 1911 are inserted, in the bolt carrier. Alternatively, a firing pin spring may not be necessary. This insertion of the bolt 1909 is accomplished by pushing the bolt into the carrier aligning it with the cam slot. The cam pin is then placed in the carrier in alignment with the firing pin hole. The firing pin and firing pin spring can next be inserted into the assembly 1910 and 1911. Next, the assembly is completed by adding the back to the carrier and installing the retaining pin 1912.

Next, the lower receiver is swung down and the bolt/carrier assembly is slid into the rear end of the upper receiver 1913. The operator pushes or uses gravity to let the bolt/carrier assembly drop forward to meet the end of the operating rod. Now, the operator pulls slightly on the cocking handle 1914 with his or her left hand. This forces the cocking piece to push against the recoil spring retaining pin located on the operating rod and forces the operating rod to move slightly rearward putting some additional preload on the recoil spring. At the same time, the operator pushes the bolt/carrier assembly forward 1915 by putting his or her finger through the ejection port of the upper receiver. As the bolt/carrier assembly is pushed forward, the engagement arm of the bolt carrier is forced over the end of the operating rod 1916 and a tang on the engagement arm is forced into a notch on the operating rod by a spring acting on the engagement arm. Now, the bolt/carrier assembly is attached securely to the operating rod 1917.

Next, the lower receiver is rotated upward to meet its rear mounting point with the upper receiver and a pin is pushed though its rear mounting point 1918.

At this point the sights, which can be either iron or telescopic, can be calibrated to the selected caliber and can be pinned to the upper receiver 1919. The standard configuration of the invention has iron sights calibrated for both the 5.56 NATO and 7.62×39 mm cartridges.

Next the correct magazine is selected and inserted 1920 into the magazine well, where it is caught by the magazine catch.

Now, the bolt carrier is drawn fully to the rear of the firearm by pulling on the cocking handle 1921. This action stores energy in the recoil spring and at the same time forces the hammer against its spring and engages it with the trigger's sear surface. As the cocking handle is released, the energy stored in the recoil spring forces the bolt forward, stripping a cartridge from the magazine. The cartridge is guided by its tip and a lip or lips on the front of the magazine well and on the end of the barrel (or its extension) into the chamber. Now the operator is ready to fire 1922.

Figure 20:
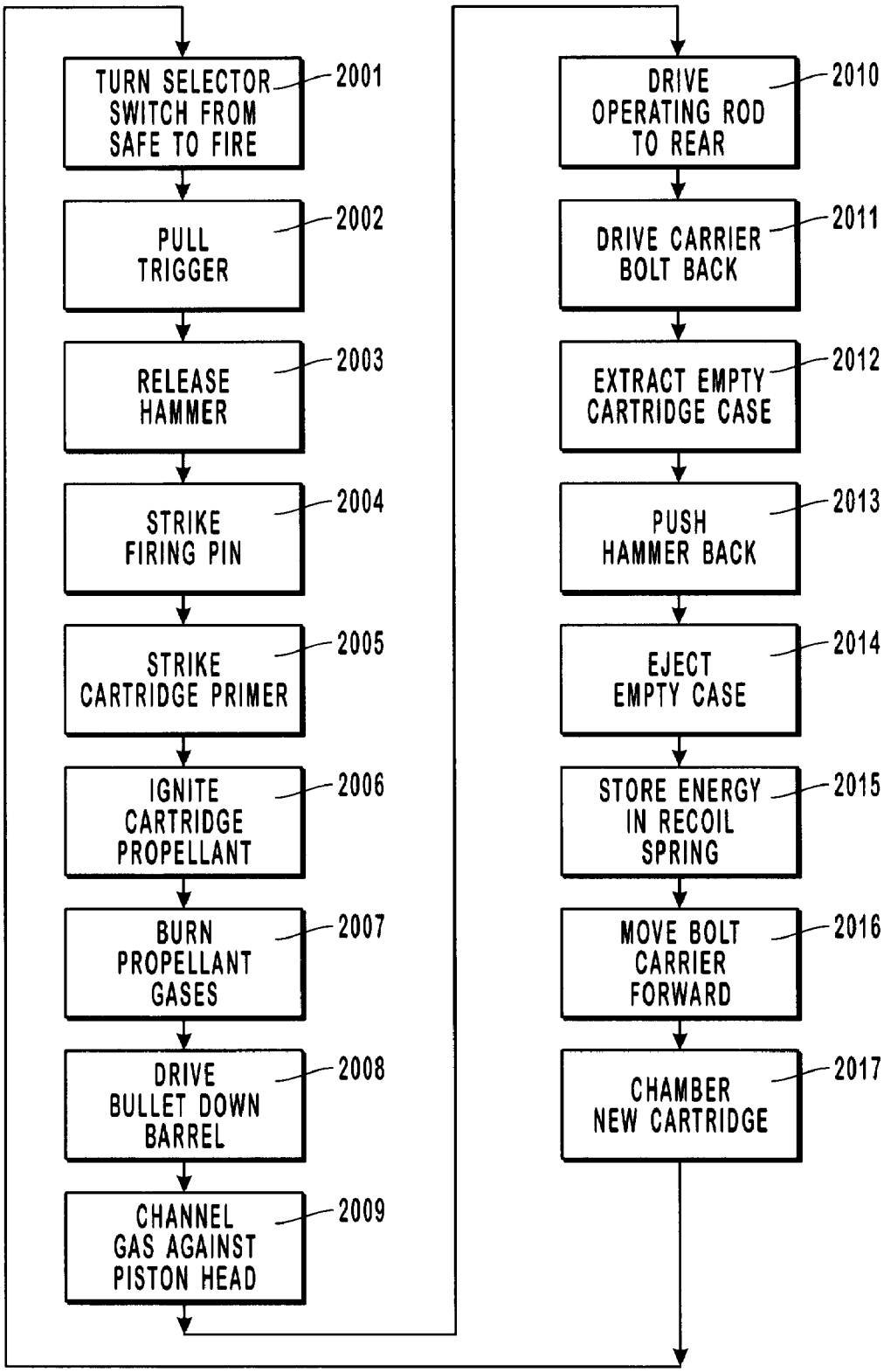
FIG. 20 is a method flow diagram showing the firing steps of the invention.

FIG. 20 is the method flow diagram for the firing of the invention. First, the operator turns the selector switch from safe to fire 2001; this turns a slot on the selector switch's cylindrical body opposite the tail of the trigger, allowing the trigger to move about its axis.

The trigger is pulled 2002, moving the trigger sear forward as does the disconnect which rotates about the same axis as the trigger. Before the trigger sear disengages with its corresponding surfaces on the side of the hammer, the disconnect contacts the protrusion on the side of the hammer. This contact requires the operator add additional pressure to the trigger to overcome the force of the disconnect spring before the trigger sear releases the hammer.

As the hammer is released 2003, it strikes the firing pin 2004, which in turn strikes the primer of a cartridge 2005. The primer ignites propellant contained within the cartridge 2006. As the propellant burns gasses are produced 2007 which expand and drive the projectile (bullet) out of the cartridge case and down the barrel of the firearm 2008. The propellant continues to burn and the gasses continue to expand. This process takes only a fraction of a second. For each different cartridge (and for different configurations or loadings of the same cartridge) the pressure/time curve for the gasses are different. This means that the gas pressure readings differ at various points between the chamber of the firearm and the muzzle.

As the projectile passes a port in the barrel, some of the gasses escape through the port and are channeled against a piston head 2009, which is connected to the end of an operating rod. The gasses press against the piston head and drive the operating rod to the rear 2010 of the firearm. As the operating rod is being driven back, it drives the bolt carrier back also 2011. The bolt carrier is cammed so that it turns the bolt out of engagement with the barrel extension. This camming action is calculated to take place once pressures in the barrel are at a safe level.

As the bolt/carrier assembly is driven to the rear, several things occur: The empty cartridge case is extracted 2012 from the chamber because it is being grabbed by an extractor claw which is located on the bolt. Also, the retreating bolt/carrier pushes the hammer back 2013 against its spring and causes it to engage again with the trigger's sear surface. At a certain point, the empty case is pushed off the bolt face and outside the upper receiver by an ejector 2014. Additionally, energy is being stored in the recoil spring which is being compressed against this rearward movement 2015.

When the bolt/carrier assembly reaches the end of its travel, it moves forward under the forces stored in the recoil spring 2016. As it does so, a new cartridge is stripped from the magazine or belt-feeding device and is chambered 2017 while the cam in the bolt carrier cams the bolt into engagement with its locking lugs. Now the process is ready to being again.

Figure 21:
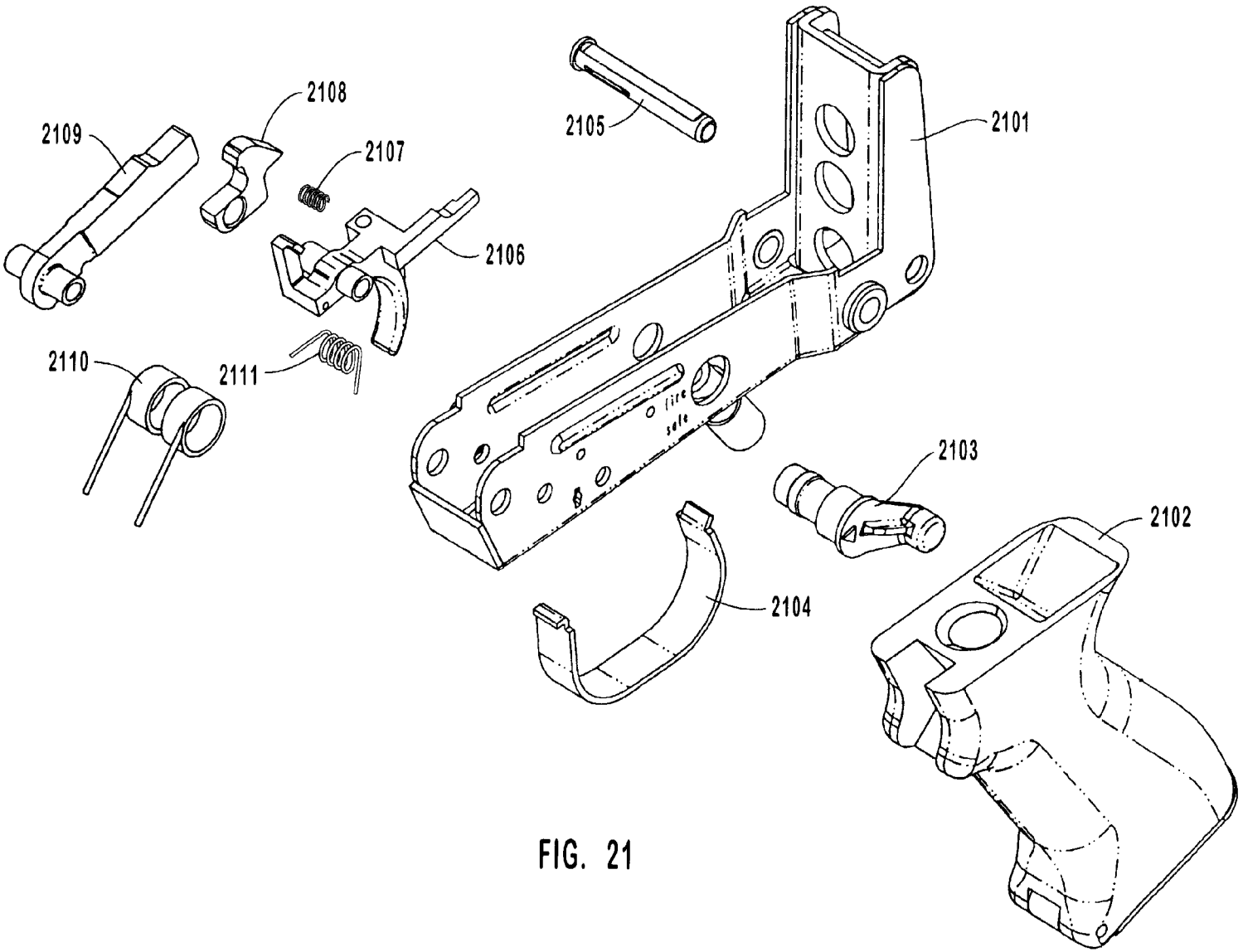
FIG. 21 is an exploded view of the subcomponents of the lower receiver.

FIG. 21 shows the exploded view of the lower receiver assembly with each component part labeled as to name and purpose. The lower receiver 2101 is shown having openings for a selector 2103 switch and a take down pin 2105. A trigger guard 2104 is shown having tabs for insertion into the bottom of the lower receiver 2101. A pistol grip 2102 is provided to give the user an acceptable grip on the gun that is the invention. A trigger 2106 is provided for the purpose of triggering the firing of the invention. Trigger 2106 tension is provided by a trigger spring 2111. Pulling on the trigger 2106 releases the disconnect 2108 which is otherwise held in place by the disconnect spring 2107, thereby releasing the hammer 2109, which in turn is sprung forward by force imposed by the hammer spring 2110.

FIG. 22 shows the detailed drawing of the front trunion 2201 which holds the gas tube in place. An inner surface 2202 is provided to contact with the tapered section of the gas tube.

Figure 23:
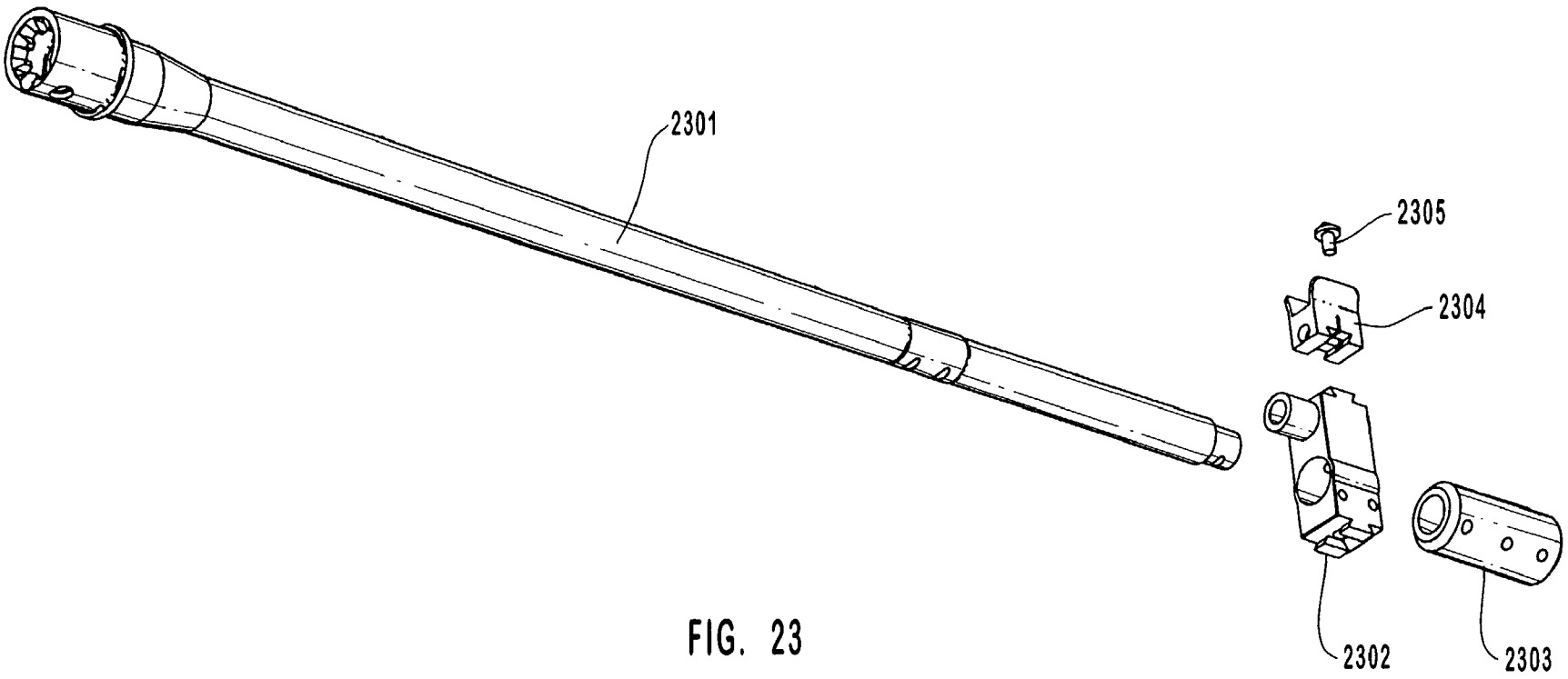
FIG. 23 is a detailed exploded view of the barrel assembly.

FIG. 23 shows an exploded view of the barrel assembly. The barrel 2301 is shown having an extension with bolt locking lugs provided at an internal end of the barrel 2301, where a muzzle compensator 2303 may be attached. A gas take-off fixture 2302 is provided to attach to the external end of the barrel 2301. A sight 2304 with a mounting bolt 2305 is provided to be fixed to the top of the gas take-off fixture 2302.

Figure 24:
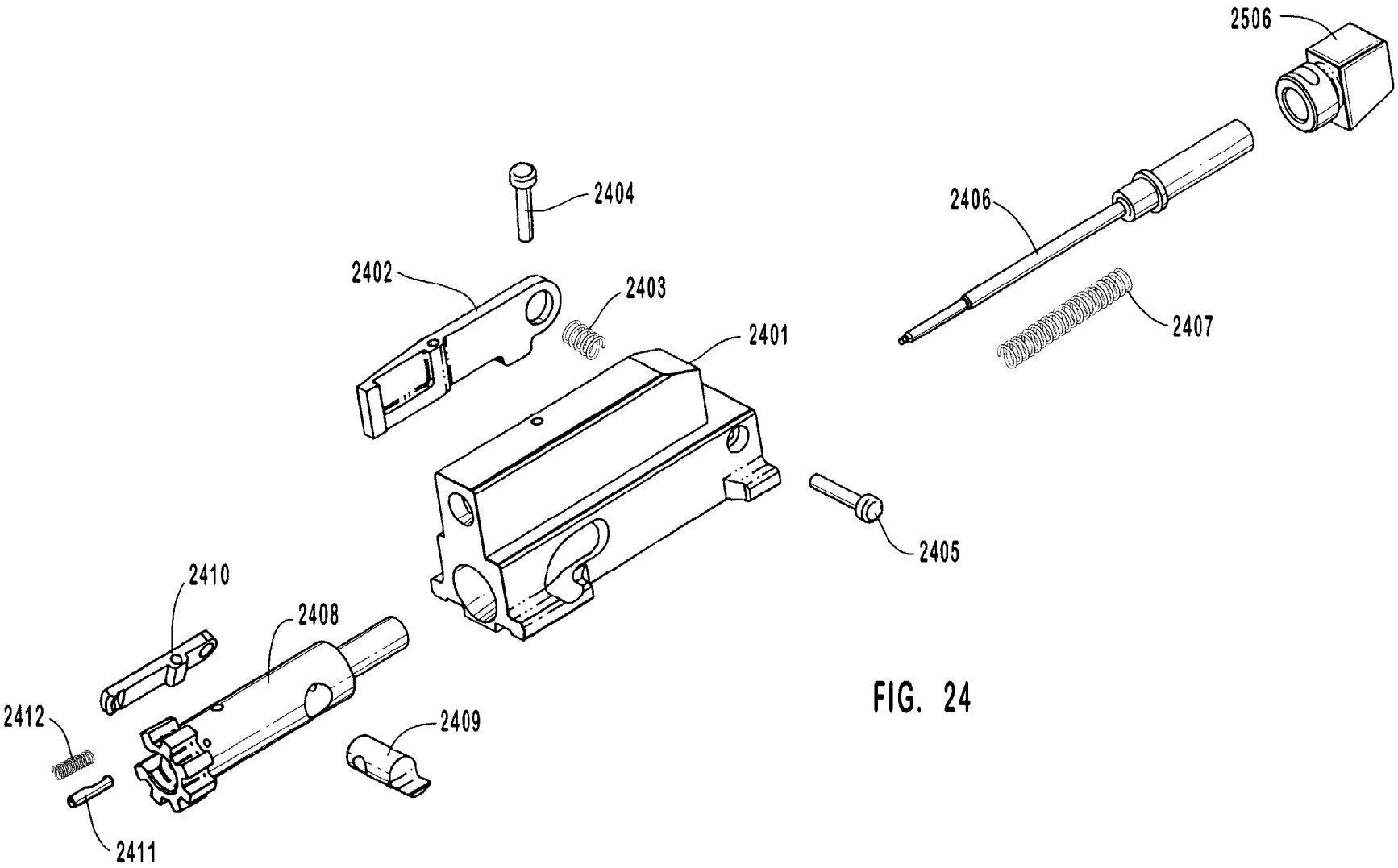
FIG. 24 is a detailed exploded view of the bolt carrier assembly.

FIG. 24 shows an exploded view of the bolt carrier assembly, from the left side view. The bolt carrier 2401 is shown adapted to receive the firing pin 2406, the bolt 2408, a firing pin retainer pin 2405, and an operating rod catch axis pin 2404. The firing pin 2406 is maintained in normal position by tension imposed by the firing pin spring 2407 and the firing pin retainer 2407*a*. The operating catch axis pin 2404 holds the operating rod catch 2402 in position in combination with the tension imposed by the operating rod catch spring 2403. The bolt 2408 is adapted to receive a bolt cam 2409, an extractor 2410. An ejector 2411, using an ejector spring 2412 is provided to eject a spent cartridge.

FIG. 25 shows an exploded view of the entire operating system assembly, as seen from the left view. The bolt carrier assembly, including the bolt carrier 2501, the operating rod catch 2502, the firing pin retainer pin 2503, the firing pin 2504, the firing pin retainer 2506, the bolt 2508, the bolt cam 2507, the extractor 2513, and the ejector 2514 are shown, similarly to that shown in detail in FIG. 24. The gas tube 2509 with a tapered region is shown. The operating rod 2510 with a slot for interacting with the operating rod catch 2502 is shown. The recoil spring 2511 and piston head 2512 are shown. This figure indicates the relative interaction between the principle components of the operating system of the invention.

FIG. 26 shows an exploded view of the operating system assembly, from the right view, further demonstrating the interaction of the components of the operating system of the invention. The bolt carrier 2501 is shown from the right side, as are the operation rod catch 2502, the bolt 2508, the bolt cam 2507, the firing pin retainer pin 2503, the firing pin 2504, the firing pin retainer 2506, the gas tube 2509, the recoil spring 2511, the operating rod 2510 and the piston head 2512. Also shown is an optional recoil buffer 2602, which is typically composed of rubber; and the operating rod catch lever spring 2601.

Figure 27:
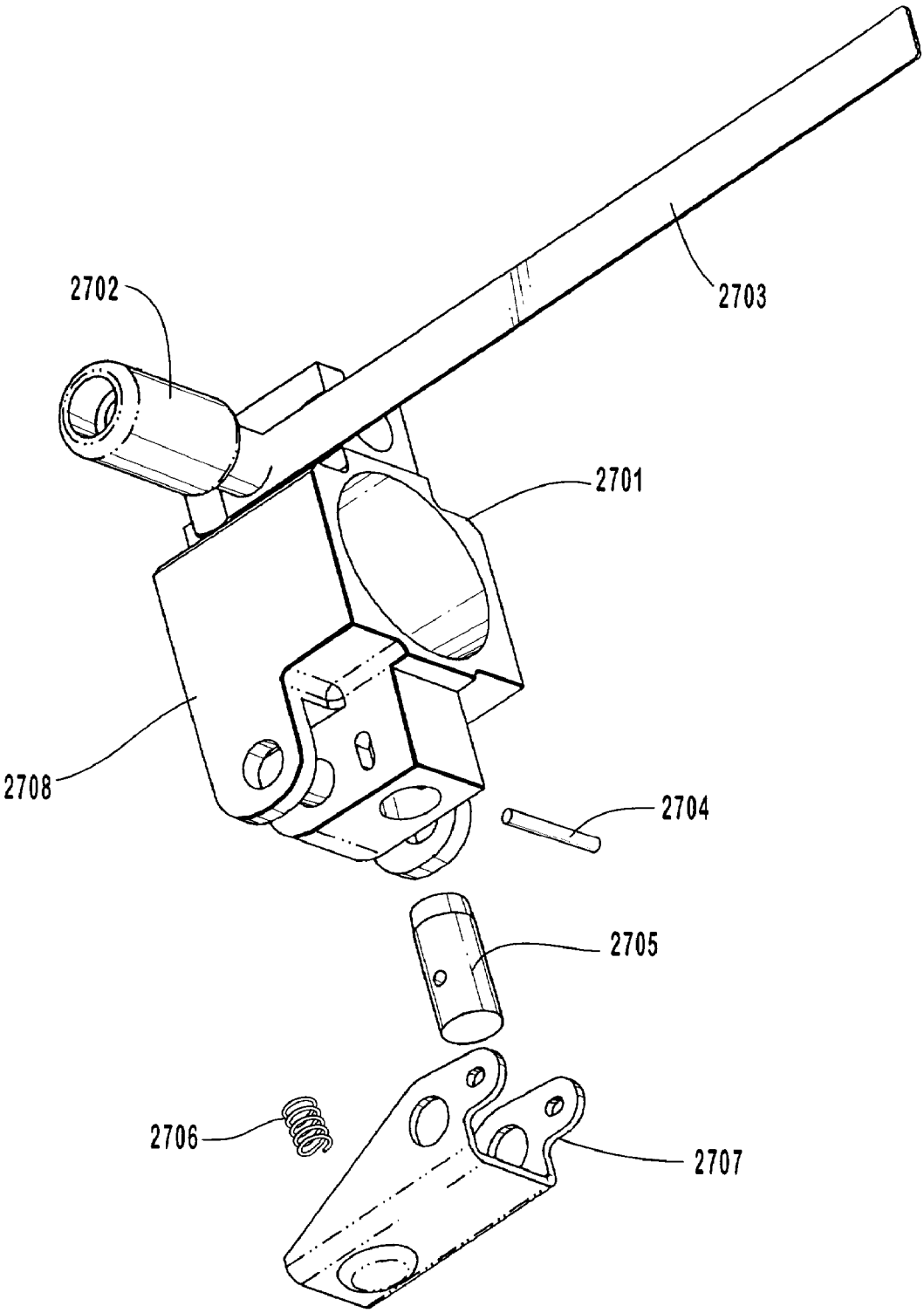
FIG. 27 is an exploded view of the left side of the trunion with the handle and slot cover.

FIG. 27 is a detailed and exploded view of the non-reciprocating cocking handle—trunion assembly 2701. The trunion 2708 provides the base for the attachment of the following component parts. The cocking handle 2702 is shown as it is typically attached to the cocking piece 2804. A cocking handle slide cover 2703 is provided. A barrel retention pin 2704 is provided, as is a barrel release pin 2705. The barrel release lever 2707 is shown with a barrel release spring 2706. This barrel release and trunion assembly permits the user's easy removal and replacement of the barrel without requiring special tools.

Figure 28:
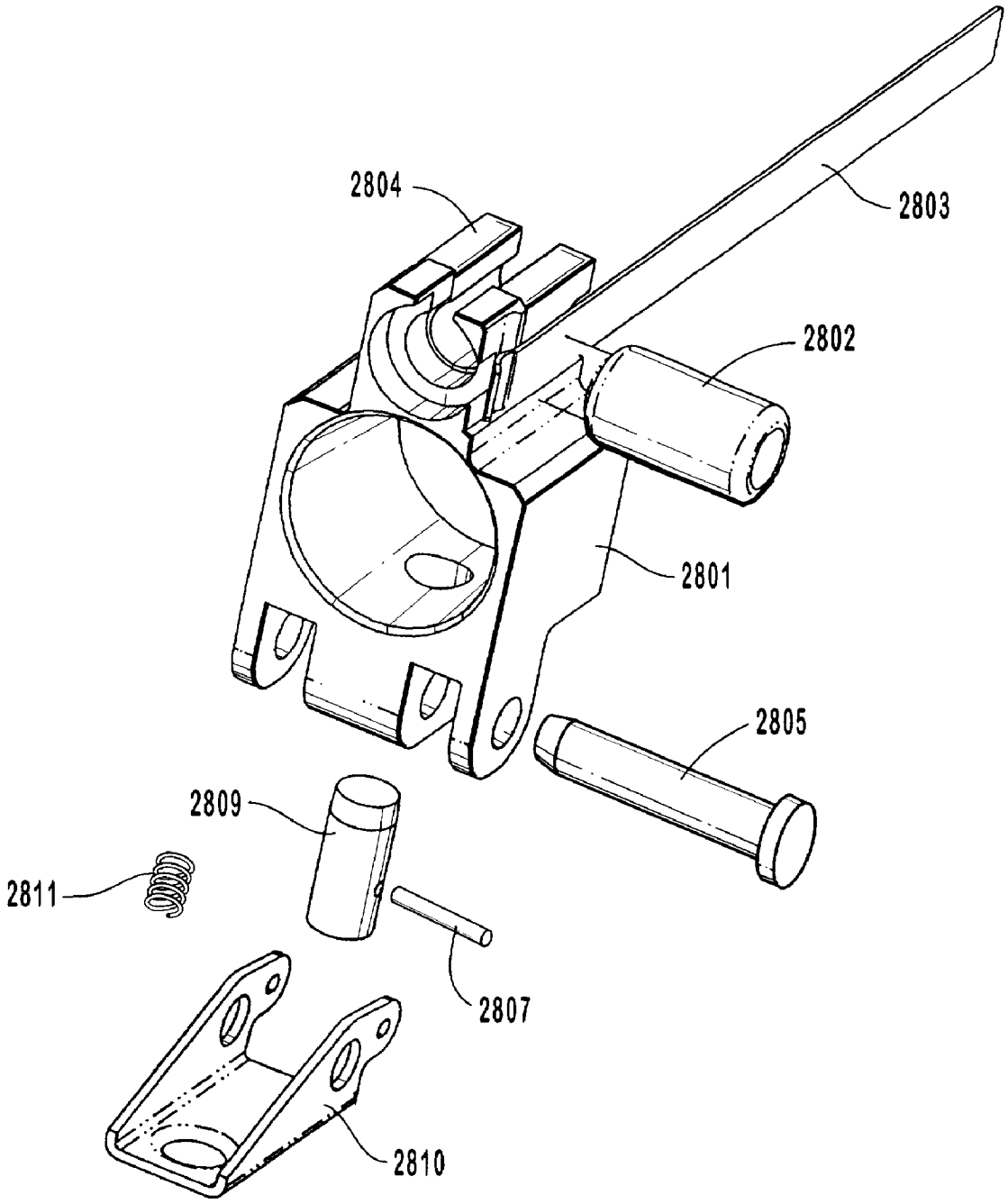
FIG. 28 is an exploded view of the front view of the trunion with the handle and slot cover.

FIG. 28 is a detailed and exploded view of the trunion and non-reciprocating cocking handle assembly 2801 as seen from the front of the invention. The cocking handle 2802 is shown attached to the cocking handle slide cover 2803 and the cocking piece 2804. The cocking piece 2804 is shown, as are the barrel release pin 2809, the barrel release spring 2811, the barrel retention pin 2807 and the detent pin 2805 having a detent ball 2806, which holds in place the barrel release lever 2110.

Figure 29:
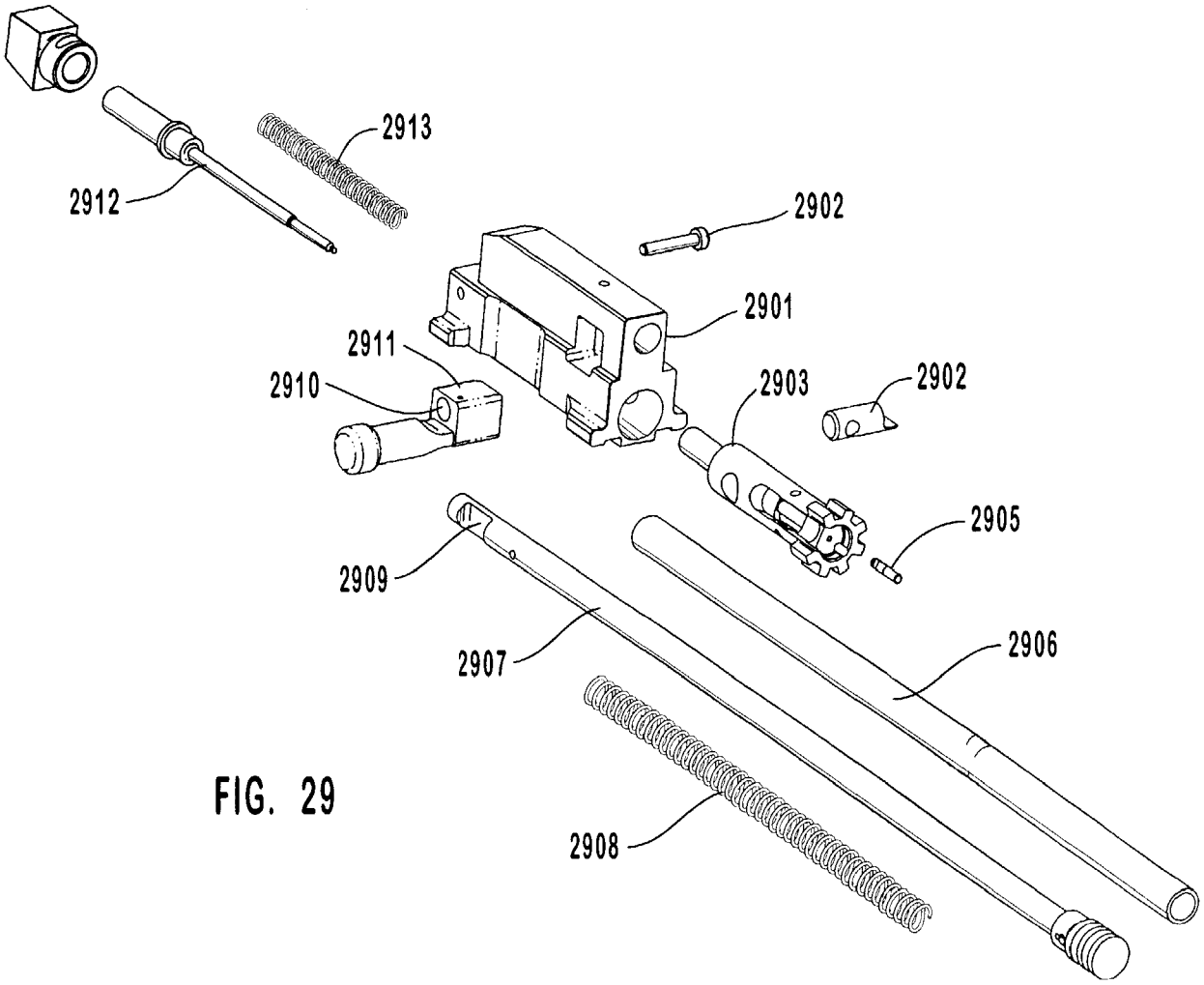
FIG. 29 is an alternative embodiment of a right hand reciprocating operating system.

FIG. 29 is a detailed and exploded view of an alternative right hand reciprocating operating system, as shown from the right view. The bolt carrier 2901 is shown having a hole for receiving the cocking handle/operating rod catch. The firing pin 2912 is shown which works with the firing pin spring 2913 and the firing pin retainer 2902 to interact with the bolt 2903. The bolt 2903 has openings for receiving a bolt cam 2904 and the ejector 2905. The gas tube 2906, with a tapered section is shown. As is the operating rod 2907 and recoil spring 2908. The bolt carrier 2901 is adapted to receive the cocking handle/operating rod catch 2909 which is provided with a cocking handle release button 2910 and a ball detent 2911 to hold the cocking handle within the bolt carrier 2901.

Figure 30:
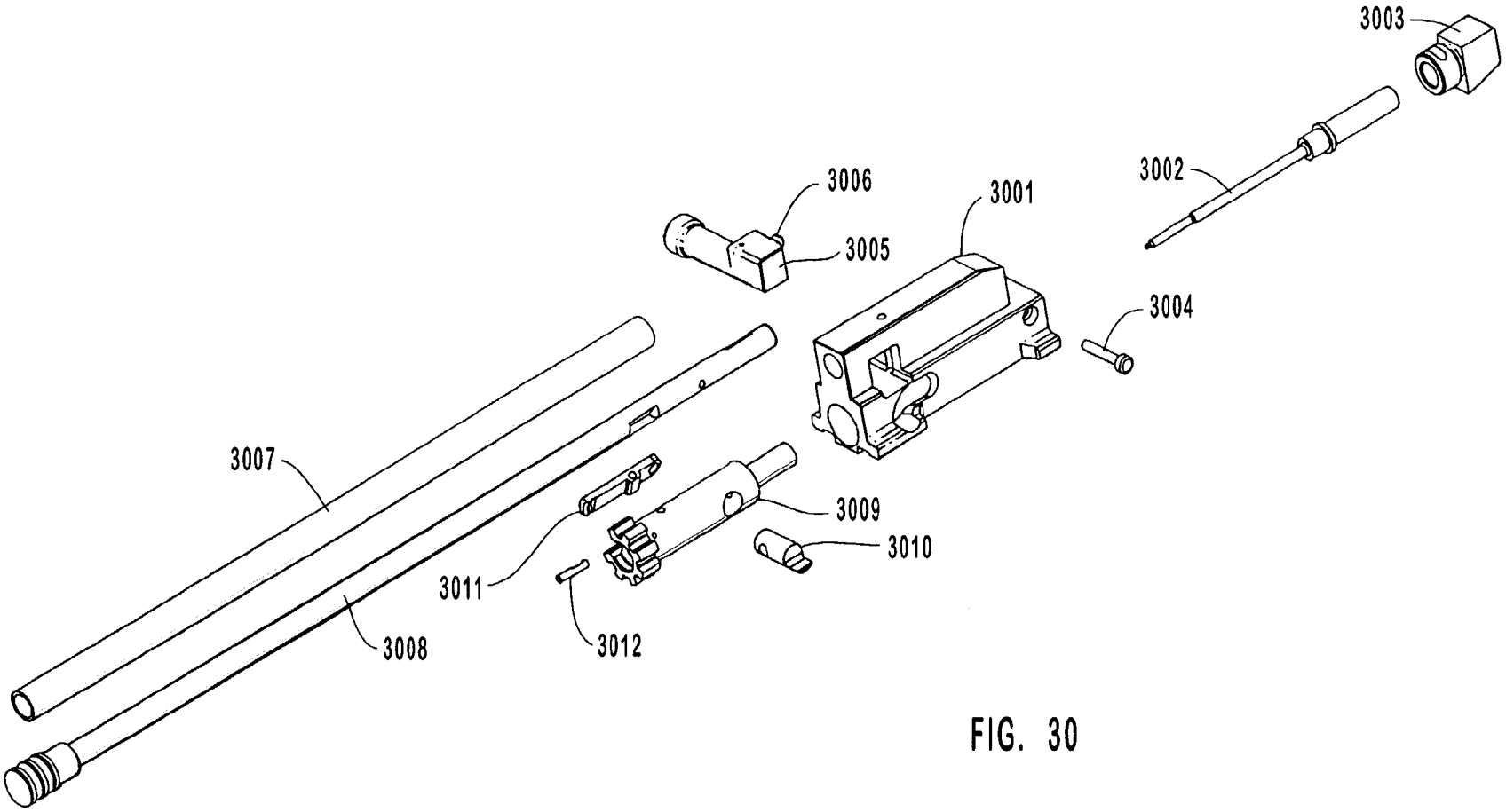
FIG. 30 is an alternative embodiment of the right hand reciprocating operating system—a left view.

FIG. 30 is an alternative detailed and exploded view of the right hand reciprocating operating system, as seen from the left view. The bolt carrier 3001 is shown with openings for receiving the firing pin retaining pin 3004; the cocking handle/operating rod catch 3005, having a detent ball 3006; the firing pin 3002, adapted to be affixed to the firing pin retainer 3003; the bolt 3009, adapted to receive the bolt cam 3010, the extractor 3011 and the ejector 3012; a gas tube 3008; and the gas tube 3007.

Figure 31:
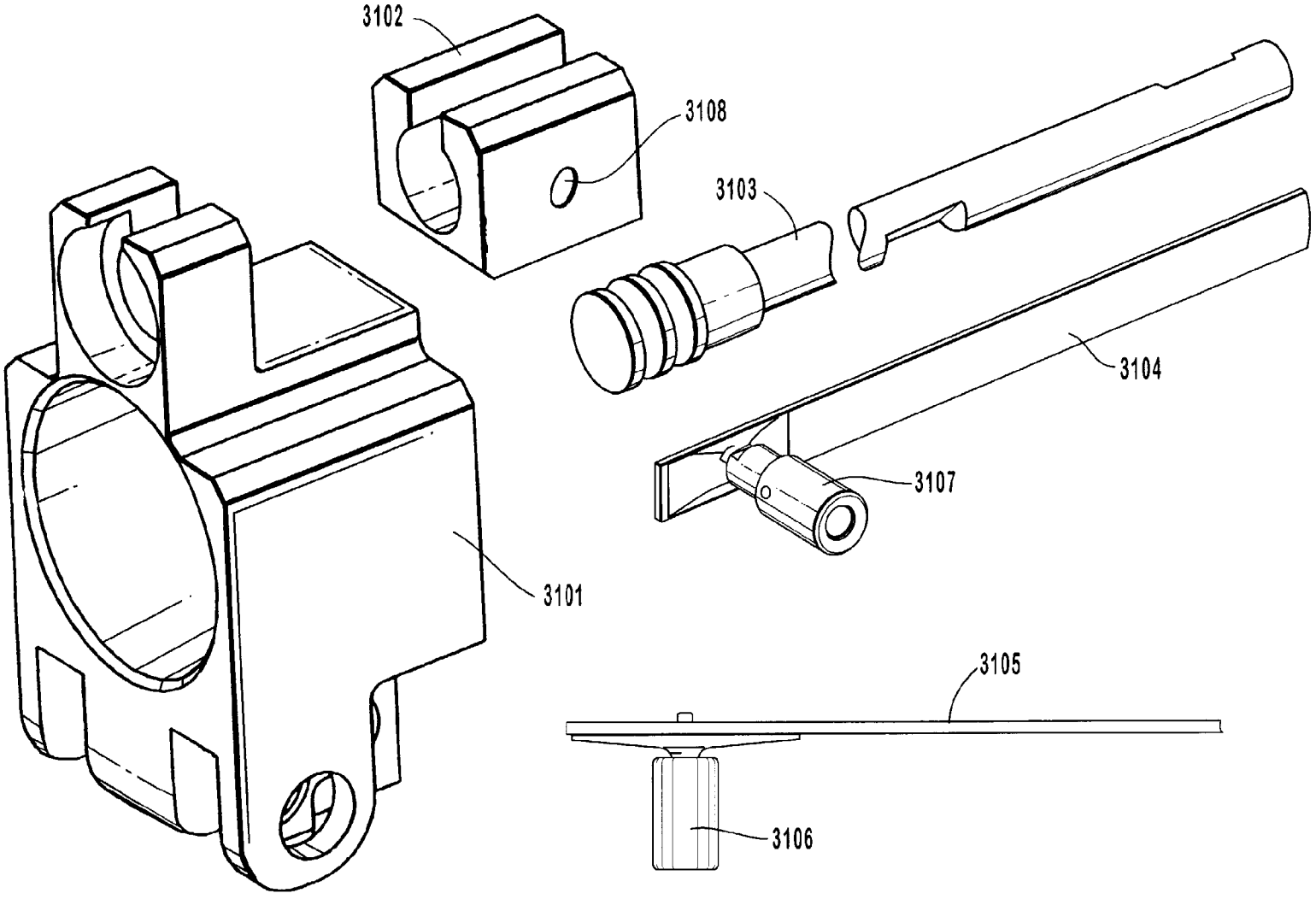
FIG. 31 is an alternative trunion and cocking handle for left hand cocking with a plunge forward bolt assist.

FIG. 31 shows an alternative embodiment of the trunion and cocking handle in a detailed and exploded view. This version of the trunion 3101 is shown adapted to receive the cocking piece 3102, which has a hole 3108 for receiving the cocking handle protrusion; the operating rod 3103, which has a slot for receiving the forward assist protrusion and the slot for operating rod catch. A side view 3104 of the cocking handle 3107 is shown. A top view 3105 of the cocking handle 3106 is shown providing a view of the cocking handle protrusion.

Figure 32:
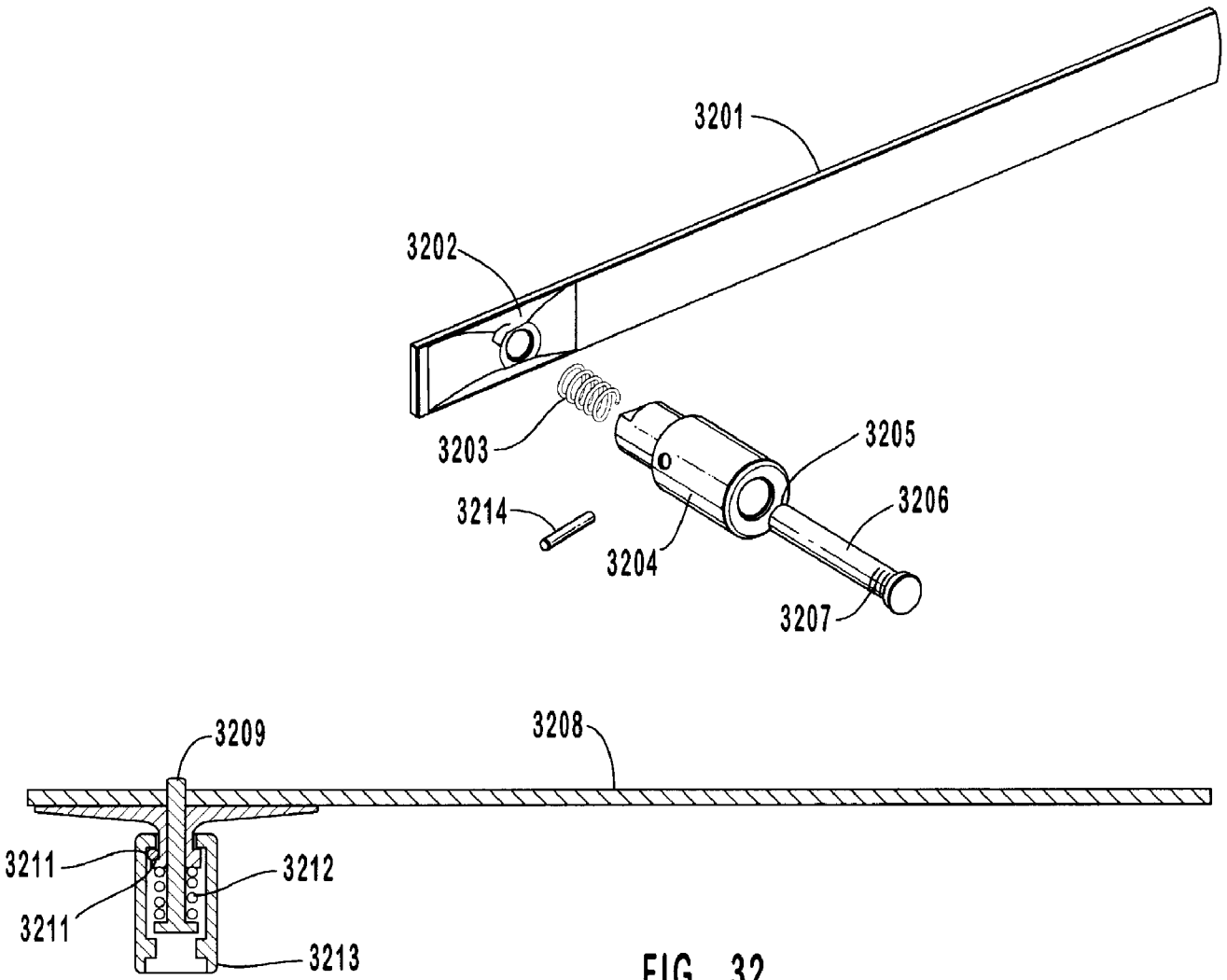
FIG. 32 is an alternative embodiment of a cocking handle for left hand cocking with a plunge forward bolt assist.

FIG. 32 is a further alternative embodiment of the cocking handle for left handed cocking with plunge forward bolt assist, shown in a detailed and exploded view. This embodiment provides a cocking handle slide 3201 with a notch provided to allow plunging of the cocking handle 3202. The cocking handle 3204 is attached in cooperation with a cocking handle plunge spring 3203 and held in place with a cocking handle bolt 3206 having a protrusion 3205 for interacting with the cocking handle retaining pin 3214 through an opening in the cocking handle 3204. The cocking handle bolt 3206 is provided with threads 3207. A top view of the assembled cocking handle and slide is shown where the slide 3208 is assembled with the cocking handle 3213 being held together with the cocking handle bolt 3210, which is shown with the protrusion 3209. The cocking handle retaining pin 3211 with threads 3212 is shown inserting in the cocking handle 3213.

Figure 33:
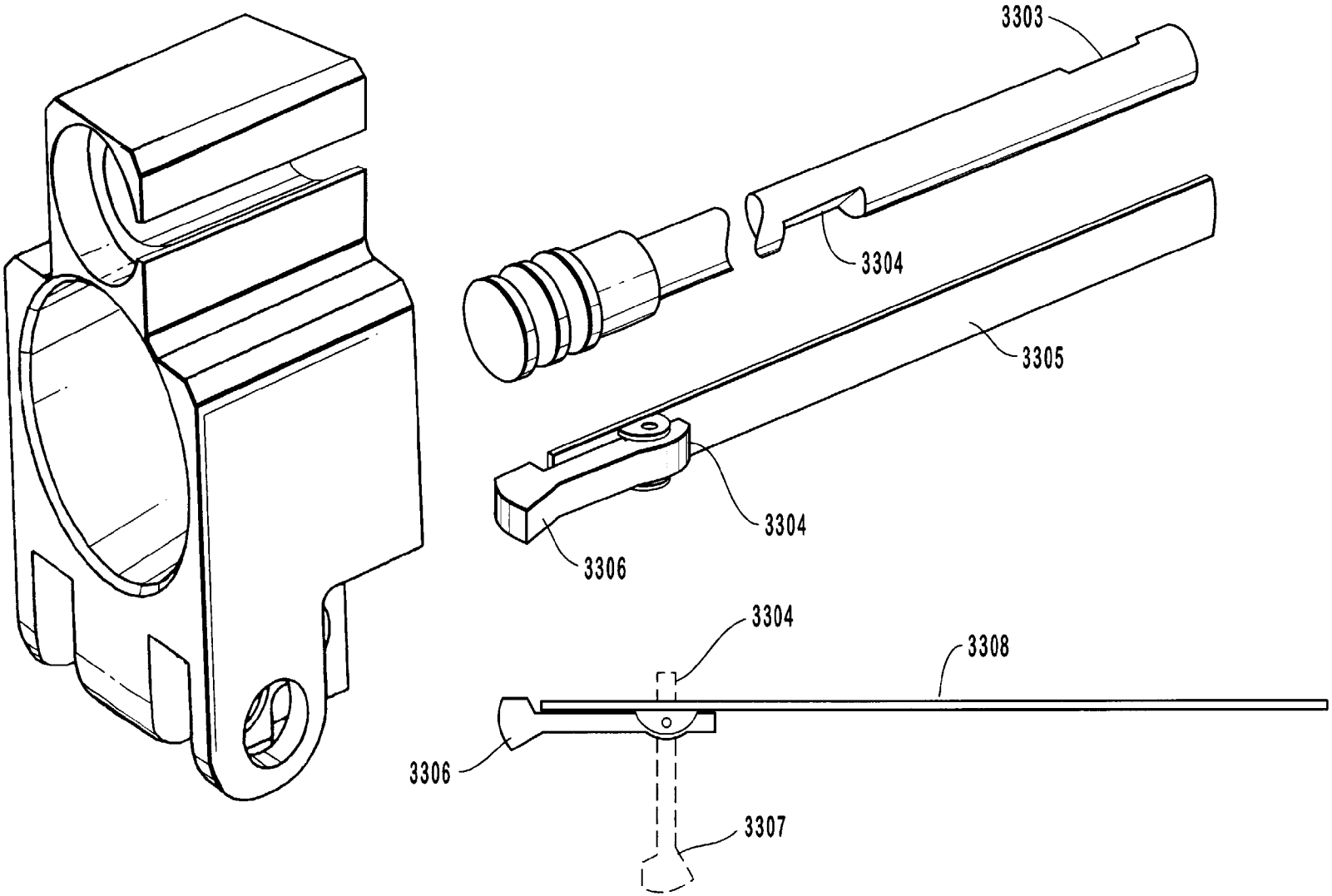
FIG. 33 is an alternative trunion for a folding cocking handle with forward bolt assist.

FIG. 33 shows an alternative embodiment of the trunion 3301, in a detailed and exploded view, for the folding cocking handle with a forward bolt assist. The trunion 3301 is provided with a slot 3302 for receiving the cocking handle protrusion 3304. The folded cocking handle 3306 is shown attached to the cocking handle slide 3308. Alternatively, the folding cocking handle is shown in the open position 3307. The stand alone cocking handle slide 3305 is shown, which is provided to cover the slot in the receiver. The operating rod 3303 is provided with slots for the operating rod catch and for receiving the cocking handle protrusion 3304.

It is to be understood that the above described embodiment of the invention is merely illustrative of numerous and varied other embodiments which may constitute applications of the principles of the invention. Such other embodiments may be readily devised by those skilled in the art without departing from the spirit or scope of this invention and it is our intent that they be deemed within the scope of the invention.

We claim:

1. A weapon system comprising:

(A) a lower receiver;

(B) an upper receiver attached to said lower receiver, wherein said upper receiver further comprises:
- (1) a first end;
- (2) a second end;
- (3) a first side;
- (4) a second side;
- (5) a mount for receiving a magazine well attached to said upper receiver, said mount being incorporated into said first side;
- (6) a trunion for accepting a barrel inserted into said upper receiver, an operating rod inserted into said upper receiver, and a gas tube inserted in said upper receiver, said trunion being incorporated into said first side;
- (7) a front trunion for attaching and stabilizing said gas tube, said front trunion being attached at said second end and said second side of said upper receiver and;
- (8) a mount adapted to connect said upper receiver to said lower receiver, said mount being adapted to permit either said first side to be connected to said lower receiver or said second side to be connected to said lower receiver (C) a bolt carrier assembly inserted in said upper receiver, wherein said bolt carrier assembly is cycleable through physical contact with said operating rod; and;

(D) a recoil spring driving said bolt carrier assembly.

* * * * *